US007827924B1

(12) United States Patent
Perez

(10) Patent No.: US 7,827,924 B1
(45) Date of Patent: Nov. 9, 2010

(54) BOAT MOORING DEVICE

(76) Inventor: Angel V. Perez, 17980 Gulf Blvd., Apartment 204, Clearwater, FL (US) 33708

( * ) Notice: Subject to any disclaimer, the term of this patent is extended or adjusted under 35 U.S.C. 154(b) by 0 days.

(21) Appl. No.: 12/454,817

(22) Filed: May 22, 2009

Related U.S. Application Data

(60) Provisional application No. 61/128,767, filed on May 23, 2008, provisional application No. 61/209,762, filed on Mar. 11, 2009.

(51) Int. Cl.
*E02B 3/24* (2006.01)

(52) U.S. Cl. ..... 114/230.15

(58) Field of Classification Search ..... 114/230.15, 114/218

See application file for complete search history.

(56) References Cited

U.S. PATENT DOCUMENTS 1,852,629 A * 4/1932 Sturges ..... 114/230.15
2,387,352 A * 10/1945 Radick ..... 114/230.15
2,602,618 A * 7/1952 Cohen ..... 43/21.2
3,108,563 A 10/1963 Wurdack
3,177,838 A 4/1965 Grimes
3,406,651 A 10/1968 Jalbert
3,861,731 A 1/1975 Young
4,459,930 A * 7/1984 Flory ..... 114/230.14
4,686,926 A 8/1987 Vance
4,708,083 A 11/1987 Billings
4,751,892 A 6/1988 Sechel et al.
4,817,551 A 4/1989 Matson
5,499,591 A 3/1996 Chippas
5,634,421 A 6/1997 Velarde
6,431,104 B1 8/2002 Webb
6,561,113 B2 5/2003 Leise
7,555,993 B2 * 7/2009 Quinn et al. ..... 114/230.11
7,637,222 B1 * 12/2009 Keely ..... 114/230.17

* cited by examiner

*Primary Examiner*—Stephen Avila
(74) *Attorney, Agent, or Firm*—Frijouf, Rust & Pyle, P.A.

(57) ABSTRACT

A mooring device is disclosed for securing a boat to an object. The boat has a first cleat and the object has a second cleat. The mooring device comprises a bar having a proximal end and a distal end. A first clamp integral to the proximal end of the bar engages the first cleat. A second clamp integral to the distal end of the bar engaging the second cleat. The first clamp and the second clamp couple the bar between the first cleat and the second cleat for securing the boat to the object.

22 Claims, 18 Drawing Sheets

BOAT MOORING DEVICE

CROSS-REFERENCE TO RELATED APPLICATIONS

This application claims benefit of U.S. Patent Provisional application Ser. No. 61/128,767 filed May 23, 2008 and U.S. Patent Provisional application Ser. No. 61/209,762 filed Mar. 11, 2009. All subject matter set forth in provisional application Ser. No. 61/128,767 and provisional application Ser. No. 61/209,762 are hereby incorporated by reference into the present application as if fully set forth herein.

BACKGROUND OF THE INVENTION

1. Field of the Invention

This invention relates to a mooring device and more particularly to the boat mooring device for securing a boat to an object.

2. Background of the Invention

Docking a vessel, and more particularly a small boat, has presented several unanswered challenges to the boater. The effects of docks or piers, tides, wind, waves, current and adjacent vessels create an extreme environment for the vessel operator to ensure the safety of the boarding or disembarking of passengers as well as the safety from damage of the vessel itself. The vessel must be maintained adjacent to, yet not in contact with the dock and/or adjacently moored vessels. Several attempts in the prior art have been made to provide a solution to the needs of the small boat operator.

U.S. Pat. No. 3,108,563 to Wurdack discloses improvements in boat mooring attachments, and, in particular, with a boat mooring attachment whereby a 'boat may be moored by a rigid boom to pilings or floating dock to prevent the boat from knocking against the pilings or dock.

U.S. Pat. No. 3,177,838 to Grimes discloses a marine mooring device and in more particularity to a mooring device for small boats. It is a primary object of the invention to provide a mooring device for fastening a boat to a stationary structure which will maintain a spaced relationship between the boat and said stationary structure at all times.

U.S. Pat. No. 3,406,651 to Jalbert discloses a boat mooring means including a novel check means which consists of at least two hollow tubes, one of which tubes is of less diameter than the other so as to snugly telescopically fit within 15 the other hollow tube, and there is means for permitting attachment of one of the tubes relative to the other to lengthen or shorten the check means as desired. The check means further includes, at the end of one of the tubes, a hook with associated closure for opening therein, 20 which associated closure acts automatically to close the opening in the hook when the same is attached to an eye bolt or the like that is fastened to the pilings of a wharf, dock or the like, or such eye bolt may be, of course, fastened to the wharf or dock proper. At the end of the other tube, there is an outwardly extending curved hook structure which is adapted to be hooked between two spaced apart knots in a line. There is a conventional cleat or what is known as a deck cleat adjacent the bow of the boat, and another such cleat adjacent the stem of the boat. One end of the said line is firmly attached to the cleat at both the front and back of the boat, and the other end of each line is attached in any suitable way, such as by securing about the piling as shown. The check means has its hooked end substantially midway between two knots in the line placed 1 to 3 feet from the boat, and, as aforesaid, its other end is attached by means of an eye bolt or the like to a piling or to the wharf or dock proper. The boat with the said lines and the check means thus positioned and secured will positively be prevented from engaging the pilings or the wharf, dock or the like during any kind of weather, rough seas, storms, waves of passing ships or boats, etc.

U.S. Pat. No. 3,861,731 to Young discloses a boat handler having a hook element which can be turned to close a hook portion on an anvil piece so that it captures a boat. The handle may be tubular and extendable or solid as with wood and the hook, anvil, sleeve and stop block may be formed from resin materials having excellent stability and resistance to corrosion and deterioration under adverse weather conditions.

U.S. Pat. No. 4,686,926 to Vance discloses a pair of identical rigid arms each pivotably attached at one end to a pair of identical brackets, one bracket attached to a boat and the other bracket attached to a dock. An elongated helically wound spring is threaded on to each end of the arms to connect them together. The arms are held in place at the bracket by pins or rods which, particularly at the boat bracket, can be quickly and easily removed to free the boat.

U.S. Pat. No. 4,708,083 to Billings discloses a hand-manipulated device for mooring boats to docks. Both of the same being provided with cleats, and the device comprising essentially an elongate spacer member having opposite end fittings each provided with an outer edge. These edges are recessed to provide a con-cave, cleat-receiving seat for proper positionment of the device. The device itself includes suitable apertures for receiving an elongate flexible member such as a cord that is loosely looped at the opposite ends of the device to loop over and engage the cleats. The cord is then pulled tight such that the loops tightly surround the cleat risers or posts,—and the cord is itself fastened to a cleat provided the device so that the cord is maintained in top condition. The device thus not only secures the boat to a dock, by the cleats of the same, but also, by virtue of the nature of the elongate spacer member, the boat is held in a spaced condition relative to the dock so that the boat sides will not be marred through jarring against the dock or its supporting pillars. The elongate spacer member is preferably of telescoping nature so that the length thereof-can be adjusted.

U.S. Pat. No. 4,751,892 to Sechel et al. discloses a marine standoff that maintains a watercraft at a fixed distance from a dock or wharf. The marine standoff may be used as a portable unit and stored on board the watercraft or may be used as a fixed unit and left permanently attached to a fixed mooring point. A preferred embodiment includes an attaching hook/clip combination on one end of the marine standoff and an elastomer tip at the other end of the marine standoff through which a line is passed through at the elastomer tip end. A stainless steel cable is attached to the safety clip portion of the hook, said cable being housed within the interior chamber of the marine standoff. The cable end which is remote from the hook is connected to an exterior pull ring which allows the remote release of the safety clip for easy removal of the standoff from a docking device such as a cleat or ring.

U.S. Pat. No. 4,817,551 to Matson discloses a device for mooring small boats including a rigid tubular sleeve with outwardly flared ends. A stretch cord located in the sleeve has attaching members in the form of hooks or the like at each end which extend at least partially outside the associated sleeve end. To moor a boat, one hook is pulled outwardly, stretching the cord, and fastened to a boat rail or cleat. The other hook is similarly fastened to a ring or eye-bolt on the dock. The stretch cord urges the hooks toward the sleeve so that the hooks and flared sleeve ends cooperate to form grips; and the sleeve acts as a spacer to space the boat from the dock.

U.S. Pat. No. 5,499,591 to Chippas discloses a mooring device for boats comprising an elongate arm having first and second ends. The arm has a transverse slot therein adjacent the first end, and dimensioned to received a cleat. The slot is in effect a fixed hook which opens to the side of the arm. A rotatable is mounted to the second end of the arm for rotation about an axis parallel to the longitudinal axis of the arm. The hook is rotatable between a closed position in which its free leg opposes the second end of the arm and an open position in which its free leg is spaced from the second end. In the closed position, the hook lies in a plane perpendicular to the plane of the slot. The hook is dimensioned to engage a cleat. A locking mechanism such as a sliding bolt is provided for locking a cleat in the slot. The arm can be telescopic, or provided with hinges which are pivotable in opposite directions, so that it can be adjusted for boarding and deboarding. Alternatively, the mooring device can further include rotatable cleats, which enable the arm to be oriented perpendicular to the boat side for docking and to be oriented at a severely acute Angel to the boat side for boarding and deboarding.

U.S. Pat. No. 5,634,421 to Velarde discloses a watercraft mooring apparatus. The apparatus includes an elongate spacing device having a generally tubular element with an interior channel formed there-through. There are a pair of resilient fender components attached to respective ends of the tubular element. Each fender component has an opening that communicates with the interior channel. A flexible line extends through and outside of the spacing device. The line has a first end portion that releasably engages a first vessel and a second end portion that releasably engages either a dock or a second vessel.

U.S. Pat. No. 6,431,104 to Webb discloses a shock absorbing docking spacer to space a tethered boat from dockside. It comprises an elongated body having two cylindrical sections moveable longitudinally of each other to define spacer length with one of said cylindrical sections being connectable to a boat and the other of said cylindrical sections being connectable to a dock. A resilient cord is connected at one of its ends to one of said cylindrical sections and at the other of its ends to the other of said cylindrical sections to be tensioned as the cylindrical sections move longitudinally of each other due to shock forces in use to reduce spacer length. The cord cord has a resilience as aforesaid to absorb shock forces on the boat that reduce the spacer length in use, and to reassert itself and restore spacer length when shock forces are removed.

U.S. Pat. No. 6,561,113 to Leise discloses a portable mooring device adaptable for attachment to existing devices, such as cleat or rail, or directly to a boat or other water craft. A flat plate is attached directly to the water craft or to an existing cleat or rail, and then an attachment device is attached to the plate. The attachment device may be a mounting plate that receives a rod secured thereto by a pin or other fastening device. The rod may be of a desired length to secure the water craft to a dock with a rope or other securing device. The rod is secured in the mounting plate so that it will not move laterally to the dock, therefore keeping the watercraft at a desired distance from the dock and preventing the water craft from hitting and rubbing against the dock, or other water craft. The rod may have a pivot point on the end attached to the mounting plate so the boat can move up and down with the movement of the water.

Although some of the devices of the prior art have addressed these problems none has successfully solved the overall issue. Therefore it is an object of this invention to provide a mooring device which maintains the vessel at a safe distance from a pier or dock in varying conditions of wind, current, tide and waves.

Another object of this invention is to provide a mooring device which will maintain a safe distance between adjacent vessels in a variety of wind and sea conditions, either when at a dock or when rafted together at anchor.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a mooring device for securing a boat to an object. The boat has a first cleat and the object has a second cleat. The first cleat and the second cleat have a first vertical member and a second vertical member separated by a horizontal member. The first vertical member, the second vertical member and the horizontal member define a first channel. The first vertical member includes a first horn aligned with the horizontal member. The first horn and first vertical member define a second channel. The second vertical member includes a second horn aligned with the horizontal member. The second horn and the second vertical member define a third channel. The mooring device comprises a bar having a proximal end and a distal end. A first plurality of fingers are integral to the proximal end of the bar for engaging the first channel, the second channel and the third channel of the first cleat. A second plurality of fingers pivotably engage the proximal end of the bar for engaging the first channel, the second channel and the third channel of the first cleat. The first plurality of fingers interlock with the second plurality of fingers for defining a first clamp engaging the first cleat. A third plurality of fingers are integral to the distal end of the bar for engaging the first channel, the second channel and the third channel of the second cleat. A fourth plurality of fingers pivotably engage the distal end of the bar for engaging the first channel, the second channel and the third channel of the second cleat. The third plurality of fingers interlock with the fourth plurality of fingers for defining a second clamp engaging the second cleat. The first clamp and said second clamp coupling the bar between the first cleat and the second cleat for securing the boat to the object.

In a more specific embodiment of the invention, the bar includes a first cylindrical tube extending from the first clamp to a first aperture and a second cylindrical tube extending from the second clamp to a second aperture. The first cylindrical tube defines a first interior bore. The second cylindrical tube defines a second interior bore. A coupling bar has a proximal end and a distal end. The proximal end of the coupling bar traverses the first aperture and slidably engages within the first interior bore of the first cylindrical tube. The distal end of the coupling bar traverses the second aperture and slidably engages within the second interior bore of the second cylindrical tube. A first lock engages the first cylindrical tube and the coupling bar for terminating displacement of the coupling bar relative to the first cylindrical tube. A second lock engages the second cylindrical tube and the coupling bar for terminating displacement of the coupling bar relative to the second cylindrical tube. The first cylindrical tube and the second cylindrical tube and the coupling bar define a first length between the first clamp and the second clamp. The displacement of the coupling bar relative to the first cylindrical tube and the second cylindrical tube define a second length between the first clamp and the second clamp.

In a more specific embodiment of the invention, a first bearing is secured to the first aperture of the first cylindrical tube. A second bearing is secured to the second aperture of the second cylindrical tube. A pin extends between the first bearing and the second bearing for pivoting the first clamp relative to the second clamp.

In one embodiment of the invention, the first plurality of fingers include primary finger, a secondary finger and a central finger coupled by a first beam. The primary finger, the secondary finger and the central finger of the first plurality of fingers have an arcuate bend for traversing the second channel, the third channel and the first channel of the first cleat respectively. The first beam has a primary pivot arm, a secondary pivot arm and a central pivot arm positioned above the primary finger, the secondary finger and the central finger. The second plurality of fingers include a major primary finger, a minor primary finger, a major secondary finger, a minor secondary finger, a major central finger and a minor central finger coupled by a second beam. The major primary finger and the minor primary finger, the major secondary finger and the minor secondary finger, the major central finger and the minor central finger have an arcuate bend for traversing the second channel, the third channel and the first channel of the first cleat respectively. The second beam has a major primary pivot arm and a minor primary pivot arm, a major secondary pivot arm and a minor secondary pivot arm, a major central pivot arm and a minor central pivot arm positioned above the major primary finger and the minor primary finger, the major secondary finger and the minor secondary finger, the major central finger and the minor central finger respectively. A first pin bore traverses the primary pivot arm, the secondary pivot arm and the central pivot arm of the first beam. A second pin bore traverses the major primary pivot arm and the minor primary pivot arm, the major secondary pivot arm and the minor secondary pivot arm, the major central pivot arm and the minor central pivot arm of the second beam. The primary pivot arm, the secondary pivot arm and the central pivot arm of the first beam are inserted between the major primary pivot arm and the minor primary pivot arm, the major secondary pivot arm and the minor secondary pivot arm, the major central pivot arm and the minor central pivot arm of the second beam respectively. A first clamp pin traversing the first pin bore and the second pin bore for pivoting the second plurality of fingers relative to the first plurality of fingers.

In another embodiment of the invention, the third plurality of fingers include primary finger, a secondary finger and a central finger coupled by a third beam. The primary finger, the secondary finger and the central finger of the third plurality of fingers have an arcuate bend for traversing the second channel, the third channel and the first channel of the second cleat respectively. The third beam has a primary pivot arm, a secondary pivot arm and a central pivot arm positioned above the primary finger, the secondary finger and the central finger. The fourth plurality of fingers include a major primary finger, a minor primary finger, a major secondary finger, a minor secondary finger, a major central finger and a minor central finger coupled by a fourth beam. The major primary finger and the minor primary finger, the major secondary finger and the minor secondary finger, the major central finger and the minor central finger have an arcuate bend for traversing the second channel, the third channel and the first channel of the second cleat respectively. The fourth beam has a major primary pivot arm and a minor primary pivot arm, a major secondary pivot arm and a minor secondary pivot arm, a major central pivot arm and a minor central pivot arm positioned above the major primary finger and the minor primary finger, the major secondary finger and the minor secondary finger, the major central finger and the minor central finger respectively. A third pin bore traverses the primary pivot arm, the secondary pivot arm and the central pivot arm of the third beam. A fourth pin bore traverses the major primary pivot arm and the minor primary pivot arm, the major secondary pivot arm and the minor secondary pivot arm, the major central pivot arm and the minor central pivot arm of the fourth beam. The primary pivot arm, the secondary pivot arm and the central pivot arm of the third beam are inserted between the major primary pivot arm and the minor primary pivot arm, the major secondary pivot arm and the minor secondary pivot arm, the major central pivot arm and the minor central pivot arm of the fourth beam respectively. A second clamp pin traverses the third pin bore and the fourth pin bore for pivoting the fourth plurality of fingers relative to the third plurality of fingers.

In another embodiment of the invention, a first lock bracket is pivotably mounted to the second plurality of fingers and traverses the second channel of the first cleat. A second lock bracket is pivotably mounted to the second plurality of fingers and traverses the third channel of the first cleat. A first lock pin traverses from the first lock bracket, behind the first plurality of fingers and traverses the second lock bracket for retaining the first plurality of fingers and the second plurality of fingers in an interlocking position. A third lock bracket is pivotably mounted to the fourth plurality of fingers and traverses the second channel of the second cleat. A fourth lock bracket is pivotably mounted to the fourth plurality of fingers and traverses the third channel of the second cleat. A second lock pin traverses from the third lock bracket, behind the third plurality of fingers and traverses the fourth lock bracket for retaining the third plurality of fingers and the fourth plurality of fingers in an interlocking position.

In another embodiment of the invention, the mooring device secures a boat to an object. The boat has a first cleat. The object has a second cleat. The first cleat and the second cleat have a first vertical member and a second vertical member secured perpendicularly to a horizontal member. The horizontal member extends between a first cleat end and a second cleat end. The mooring device comprises a bar having a proximal end and a distal end. A first C-clamp is secured to the proximal end of the bar for engaging the first cleat to the bar. The first C-clamp includes a primary C-clamp arm and a secondary C-clamp arm. The primary C-clamp arm of the first C-clamp extends between a major cylindrical channel and a major cleat socket. The secondary C-clamp arm of the first C-clamp extends between a minor rod and a minor cleat socket. The minor rod of the secondary C-clamp arm of the first C-clamp slidably engages within the major cylindrical channel of the primary C-clamp arm of the first C-clamp for adjusting the distance between the major cleat socket and the minor cleat socket of the first C-clamp. A first C-clamp stop locks the secondary C-clamp arm of the first C-clamp relative to the primary C-clamp arm of the first C-clamp for terminating displacement between the major cleat socket and the minor cleat socket of the first C-clamp. The major cleat socket and the minor cleat socket of the first C-clamp engages the first cleat end and the second cleat end of the first cleat respectively upon the minor rod of the secondary C-clamp arm of the first C-clamp slidably engaging within the major cylindrical channel of the primary C-clamp arm of the first C-clamp for securing the first cleat to the bar and defining a first cleat pivot. The first cleat pivot permits the first C-clamp to pivot relative to the first cleat. A second C-clamp is secured to the distal end of the bar for engages the second cleat to the bar. The second C-clamp includes a primary C-clamp arm and a secondary C-clamp arm. The primary C-clamp arm of the second C-clamp extends between a major cylindrical channel and a major cleat socket. The secondary C-clamp arm of the second C-clamp extends between a minor rod and a minor cleat socket. The minor rod of the secondary C-clamp arm of the second C-clamp slidably engages within the major cylindrical channel of the primary C-clamp arm of the second C-clamp for adjusting the distance between the major cleat socket and the minor cleat socket of the second C-clamp. A second C-clamp stop locks the secondary C-clamp arm of the second C-clamp relative to the primary C-clamp arm of the second C-clamp for terminating displacement between the major cleat socket and the minor cleat socket of the second C-clamp. The major cleat socket and the minor cleat socket of the second C-clamp engaging the first cleat end and the second cleat end of the second cleat respectively upon the minor rod of the secondary C-clamp arm of the second C-clamp slidably engages within the major cylindrical channel of the primary C-clamp arm of the second C-clamp for securing the second cleat to the bar and defining a second cleat pivot. The second cleat pivot permits the second C-clamp to pivot relative to the second cleat.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
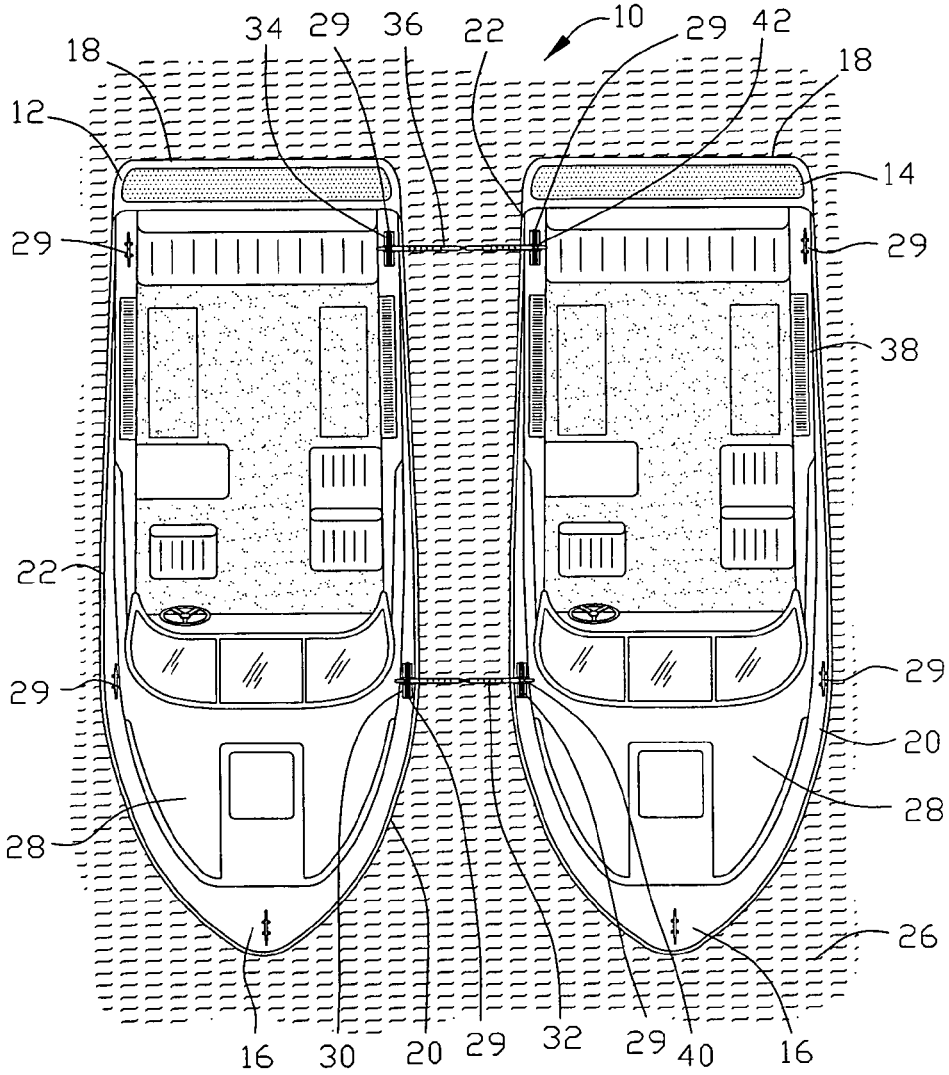
FIG. 1 is a top view of a mooring device of the present invention securing a first boat to a second boat.
Figure 2:
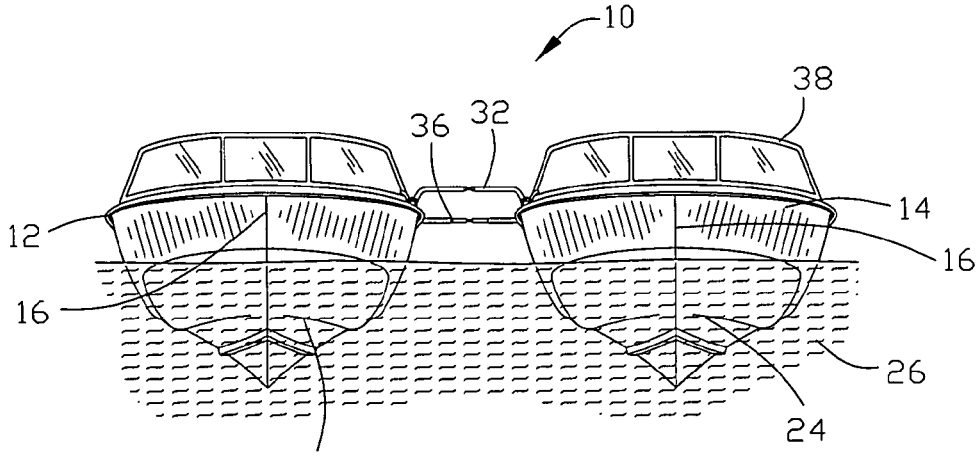
FIG. 2 is a front view of FIG. 1.
Figure 3:
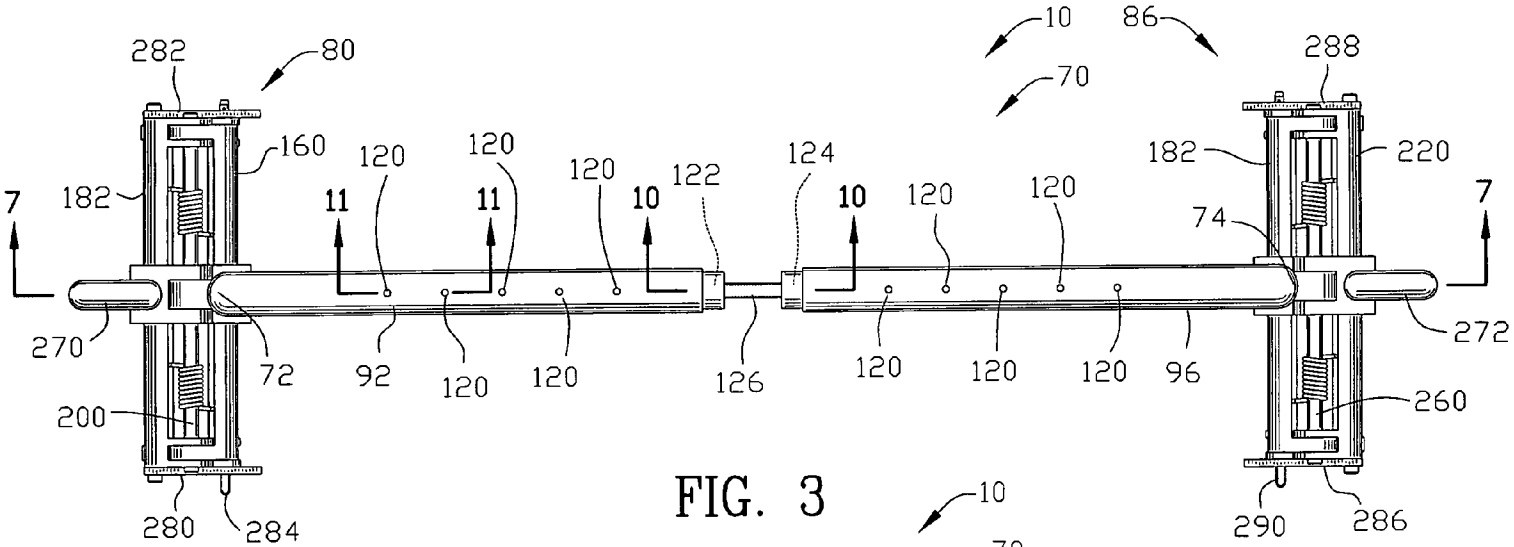
FIG. 3 is a top view of the mooring device.
Figure 4:
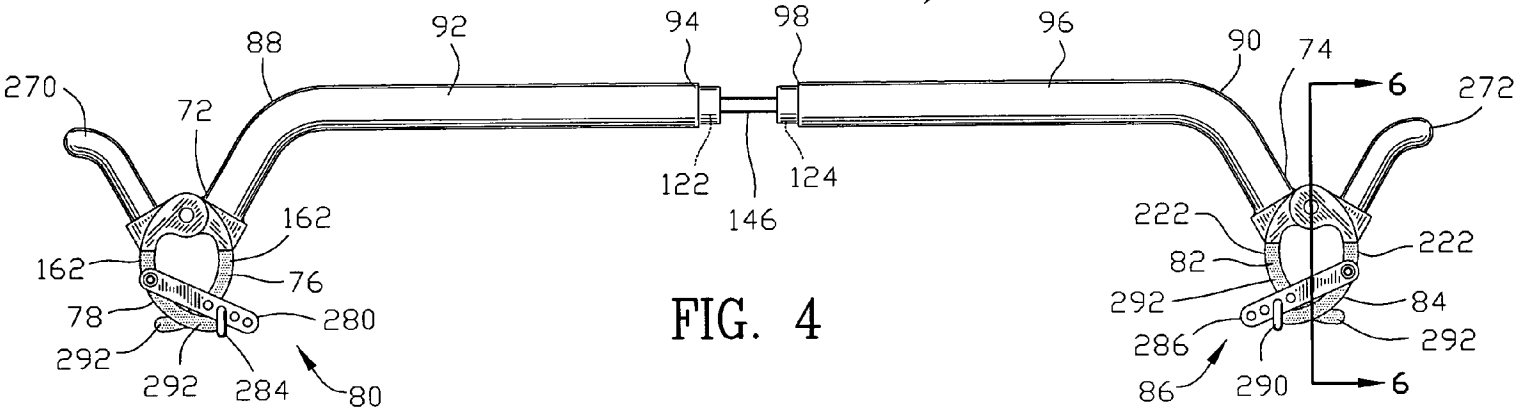
FIG. 4 is a front view of FIG. 3.
Figure 5:
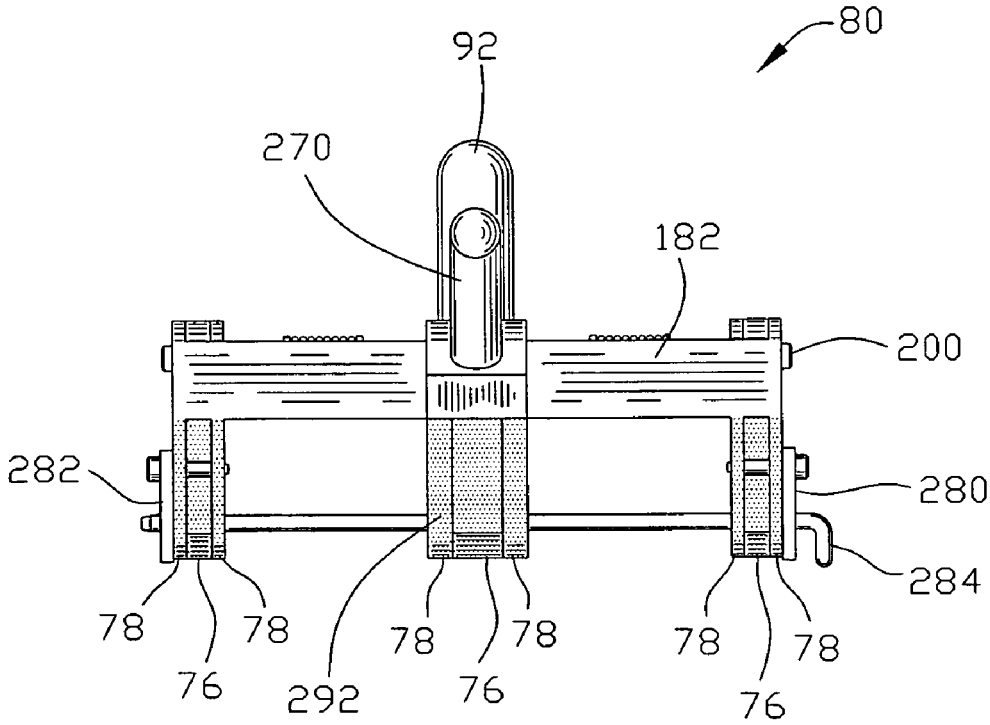
FIG. 5 is a left side view of FIG. 4.
Figure 6:
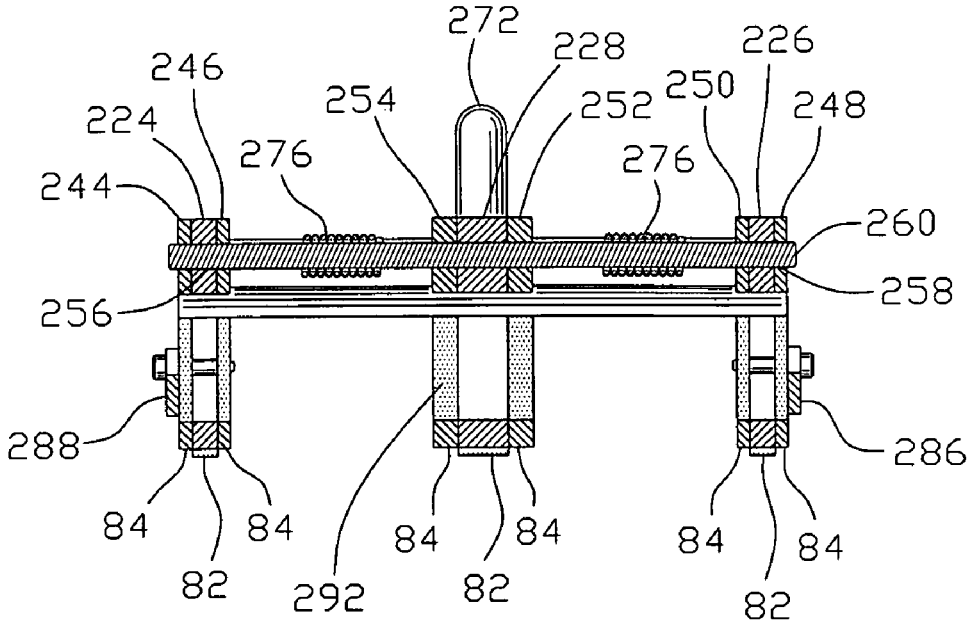
FIG. 6 is a sectional view along line 6-6 in FIG. 4.
Figure 16:
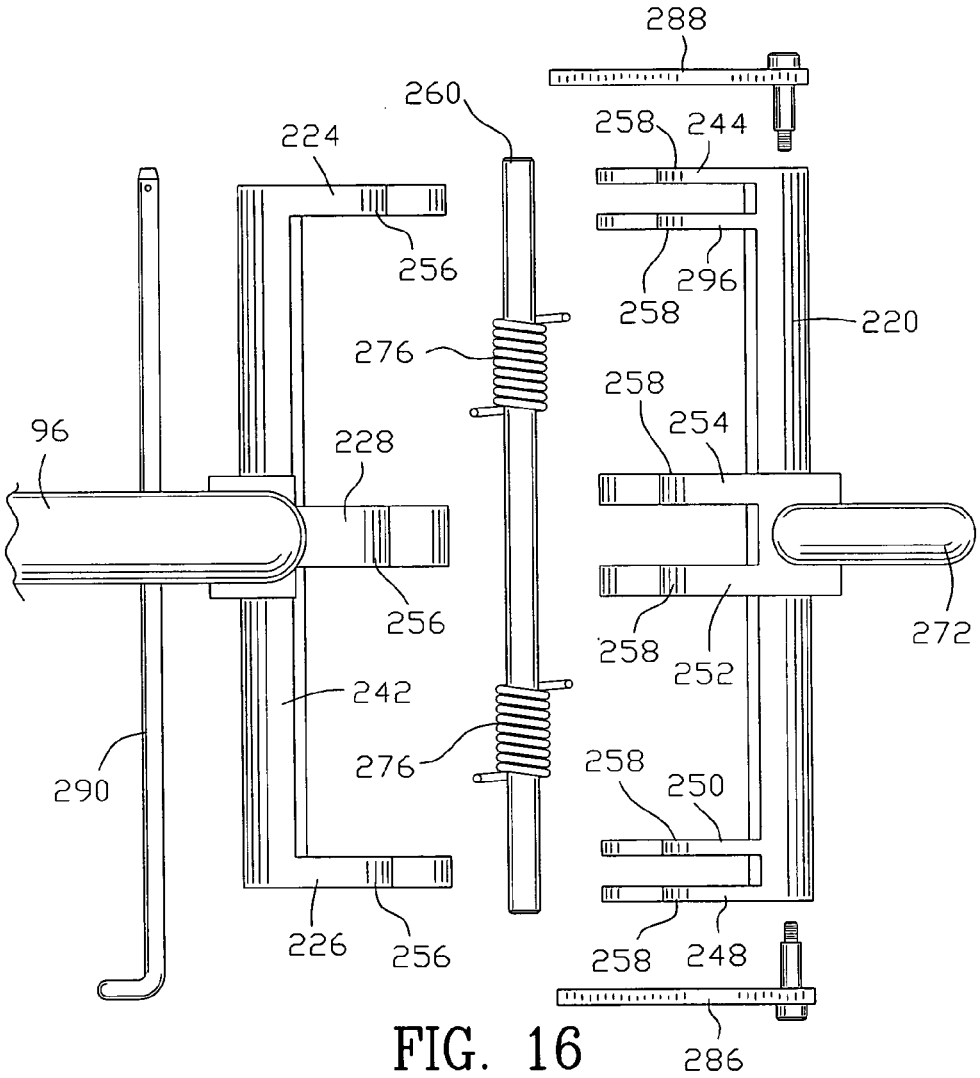
FIG. 16 is an exploded view of a portion of FIG. 3 illustrating a second clamp.
Figure 17:
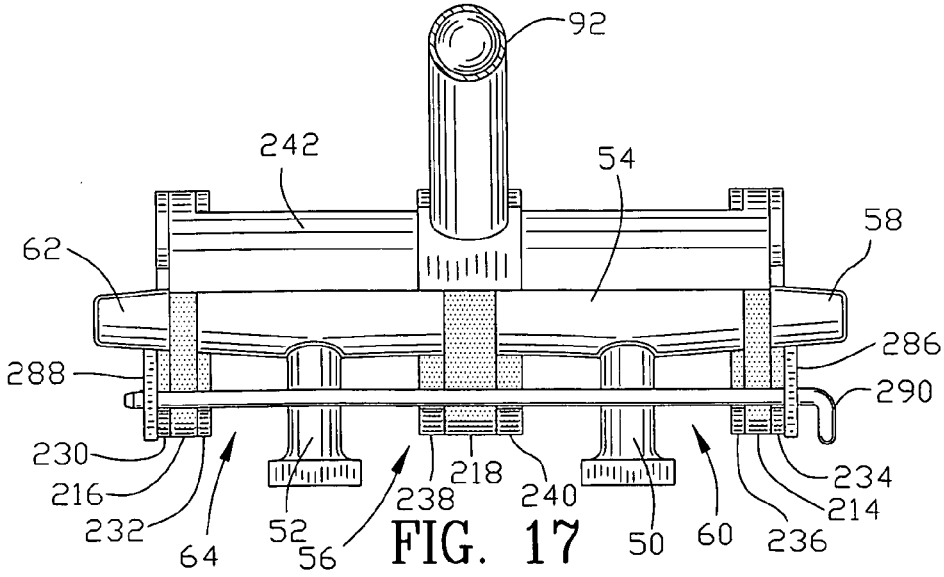
FIG. 17 a sectional view along line 17-17 in FIG. 14.

FIGS. 1-19 are various views of a mooring device 10 for securing a boat 12 to an object 14. The boat 12 includes a bow 16, a stern 18, a port side 20 and a starboard side 22. The boat 12 further includes a hull 24 for displacing water 26 and a deck 28 for carrying passengers. The deck 28 of the boat 12 includes a plurality of cleats 29 for receiving the mooring device 10. The boat 12 is shown having a first bow cleat 30 receiving a first mooring device 32 and a first stern cleat 34 receiving a second mooring device 36. FIGS. 1 and 2 illustrate the object 14 including a second boat 38 also having a bow 16, a stern 18, a port side 20 and a starboard side 22. The second boat 38 further includes a hull 24 for displacing water 26 and a deck 28 for carrying passengers. The deck 28 of the second boat 38 includes a plurality of cleats 29 for receiving the mooring device 10. The second boat 38 is shown having a second bow cleat 40 receiving the first mooring device 32 and a second stern cleat 42 receiving the second mooring device 36 for securing the first boat 12 to the second boat 38. FIGS. 16 and 17 illustrate the object 14 including a dock 44. The dock 44 includes a deck 46 and a vertical support 48.

As best seen in FIGS. 12 thru 15, the first cleats 30 and 34 and the second cleats 40 and 42 have a first vertical member 50 and a second vertical member 52 separated by a horizontal member 54. The horizontal member 54 extends between a first cleat end 66 and a second cleat end 68. The first vertical member 50, the second vertical member 52 and the horizontal member 54 define a first channel 56. The first vertical member 50 includes a first horn 58 aligned with the horizontal member 54. The first horn 58 and first vertical member 50 define a second channel 60. The second vertical member 52 includes a second horn 62 aligned with the horizontal member 54. The second horn 62 and the second vertical member 52 define a third channel 64.

As best seen in FIGS. 3 thru 11, the mooring device 10 comprises a bar 70 having a proximal end 72 and a distal end 74. A first plurality of fingers 76 are integral to the proximal end 72 of the bar 70 for engaging the first channel 56, the second channel 60 and the third channel 64 of the first cleat 30. A second plurality of fingers 78 pivotably engage the proximal end 72 of the bar 70 for engaging the first channel 56, the second channel 60 and the third channel 64 of the first cleat 30. The first plurality of fingers 76 interlock with the second plurality of fingers 78 for defining a first clamp 80 engaging the first cleat 30.

A third plurality of fingers 82 are integral to the distal end 74 of the bar 70 for engaging the first channel 56, the second channel 60 and the third channel 64 of the second cleat 40. A fourth plurality of fingers 84 pivotably engage the distal end 74 of the bar 70 for engaging the first channel 56, the second channel 60 and the third channel 64 of the second cleat 40. The third plurality of fingers 82 interlock with the fourth plurality of fingers 84 for defining a second clamp 86 engaging the second cleat 40. The first clamp 80 and the second clamp 86 couple the bar 70 between the first cleat 30 and the second cleat 40 for securing the boat 12 to the object 14.

The proximal end 72 of the bar 70 including a first arcuate bend 88 for positioning the bar 70 above the first clamp 80. The distal end 74 of the bar 70 includes a second arcuate bend 90 for positioning the bar 70 above the second clamp 86. The first arcuate bend 88 is aligned with the second arcuate bend 90 for aligning the first clamp 80 and the second clamp 86. As best seen in FIGS. 2 14 thru 16, the first arcuate bend 88 and the second arcuate bend 90 further provide clearance such that the bar 70 may not make contact with either the deck 28 of the boat 12 and/or the object 14.

Figure 7:
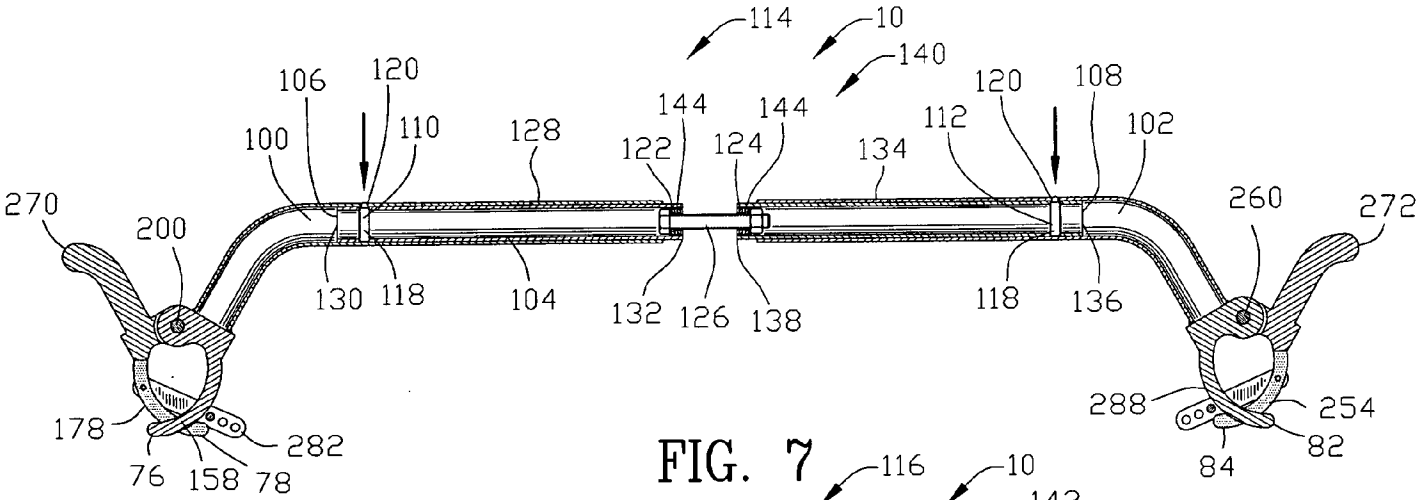
FIG. 7 is a sectional view along line 7-7 in FIG. 3.
Figure 8:
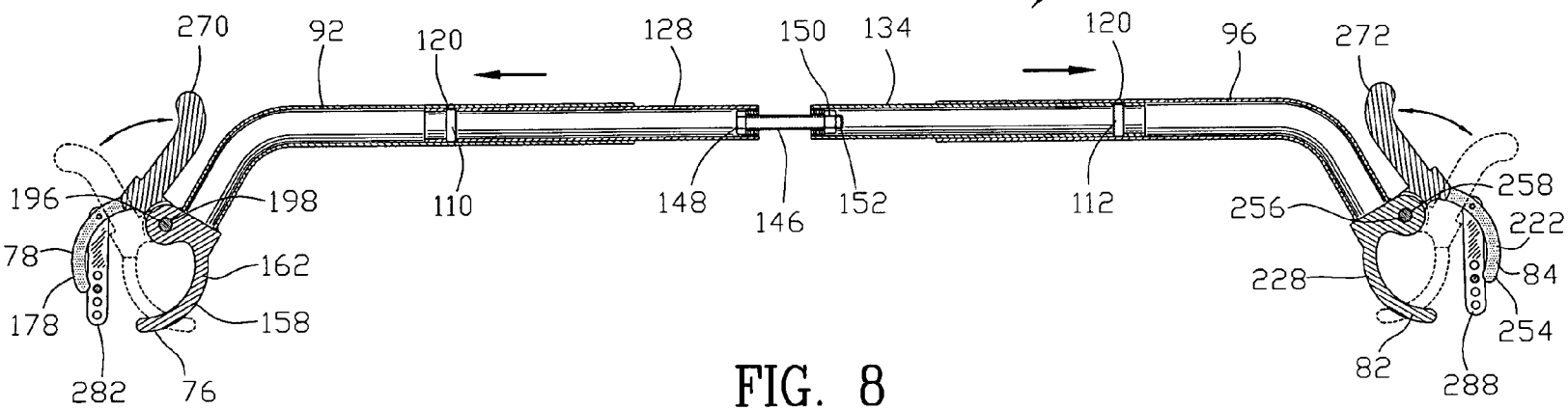
FIG. 8 is a view similar to FIG. 7 illustrating a first clamp and a second clamp being disengaged and a first telescoping bar and a second telescoping bar being lengthened.

The bar 70 further includes a first cylindrical tube 92 extending from the first clamp 80 to a first aperture 94 and a second cylindrical tube 96 extending from the second clamp 86 to a second aperture 98. The first cylindrical tube 92 defines a first interior bore 100. The second cylindrical tube 96 defines a second interior bore 102. A coupling bar 104 has a proximal end 106 and a distal end 108. The proximal end 106 of the coupling bar 104 traverses the first aperture 94 and slidably engages within the first interior bore 100 of the first cylindrical tube 92. The distal end 108 of the coupling bar 104 traverses the second aperture 98 and slidably engages within the second interior bore 102 of the second cylindrical tube 96. A first lock 110 engages the first cylindrical tube 92 and the coupling bar 104 for terminating displacement of the coupling bar 104 relative to the first cylindrical tube 92. A second lock 112 engages the second cylindrical tube 96 and the coupling bar 104 for terminating displacement of the coupling bar 104 relative to the second cylindrical tube 96. As seen in FIG. 7, the first cylindrical tube 92 and the second cylindrical tube 96 and the coupling bar 104 define a first length 114 between the first clamp 80 and the second clamp 86. As seen in FIG. 8, the displacement of the coupling bar 104 relative to the first cylindrical tube 92 and the second cylindrical tube 96 define a second length 116 between the first clamp 80 and the second clamp 86. The first lock 110 and the second lock 112 may include a retractable pin 118 that may be set into a plurality of holes 120 for locking the first cylindrical tube 92 and the second cylindrical tube 96 relative to the coupling bar 104.

In one embodiment of the subject invention, a first bearing 122 is secured to the first aperture 94 of the first cylindrical tube 92. A second bearing 124 is secured to the second aperture 98 of the second cylindrical tube 96. A pin 126 extends between the first bearing 122 and the second bearing 124 for pivoting the first clamp 80 relative to the second clamp 86.

In an alternative embodiment, a first coupling bar 128 has a proximal end 130 and a distal end 132. The proximal end 130 of the first coupling bar 128 traverses the first aperture 94 and slidably engages within the first interior bore 100 of the first cylindrical tube 92. The first bearing 122 is secured to the distal end 132 of the first coupling bar 128. A second coupling bar 134 has a proximal end 136 and a distal end 138.

The proximal end 136 of the second coupling bar 134 traverses the second aperture 98 and slidably engages within the second interior bore 102 of the second cylindrical tube 96. The second bearing 124 is secured to the distal end 138 of the second coupling bar 134. The first lock 110 engages the first cylindrical tube 92 and the first coupling bar 128 for terminating displacement of the first coupling bar 128 relative to the first cylindrical tube 92. The second lock 112 engages the second cylindrical tube 96 and the second coupling bar 134 for terminating displacement of the second coupling bar 134 relative to the second cylindrical tube 96. The pin 126 extends between the first bearing 122 and the second bearing 124 for pivoting the first clamp 80 relative to the second clamp 86.

The first cylindrical tube 92 and the first coupling bar 128 and the second cylindrical tube 96 and the second coupling bar 134 define a first length 140 between the first clamp 80 and the second clamp 86. The displacement of the first coupling bar 128 relative to the first cylindrical tube 92 and/or the displacement of the second coupling bar 134 relative to the second cylindrical tube 96 define a second length 142 between the first clamp 80 and the second clamp 86.

The first bearing 122 and the second bearing 124 may include a ball bearing 144. The ball bearing 144 may be secured within the first coupling bar 128 and the second coupling bar 134 by either a compression fitting, adhesive and or by welding. Furthermore, the pin 126 may include a bolt 146 wherein a head 148 of the bolt 146 is positioned adjacent to the first bearing 122 and a nut 150 is positioned adjacent to the second bearing 124 for engaging a thread 152 of the bolt 146. The head 148 of the bolt 146 may be secured adjacent to the first bearing 122 by either a compression fitting, adhesives and or by welding. Similarly, the nut 150 may be secured adjacent to the second bearing 124 by either a compression fitting, adhesives and or welding. The pivoting of the first clamp 80 relative to the second clamp 86 as provided by the first bearing 122, the second bearing 124 and the pin 126 eliminates any torque forces applied to the mooring device 10 due to displacement of the boat 12 relative to the object 14.

Figure 9:
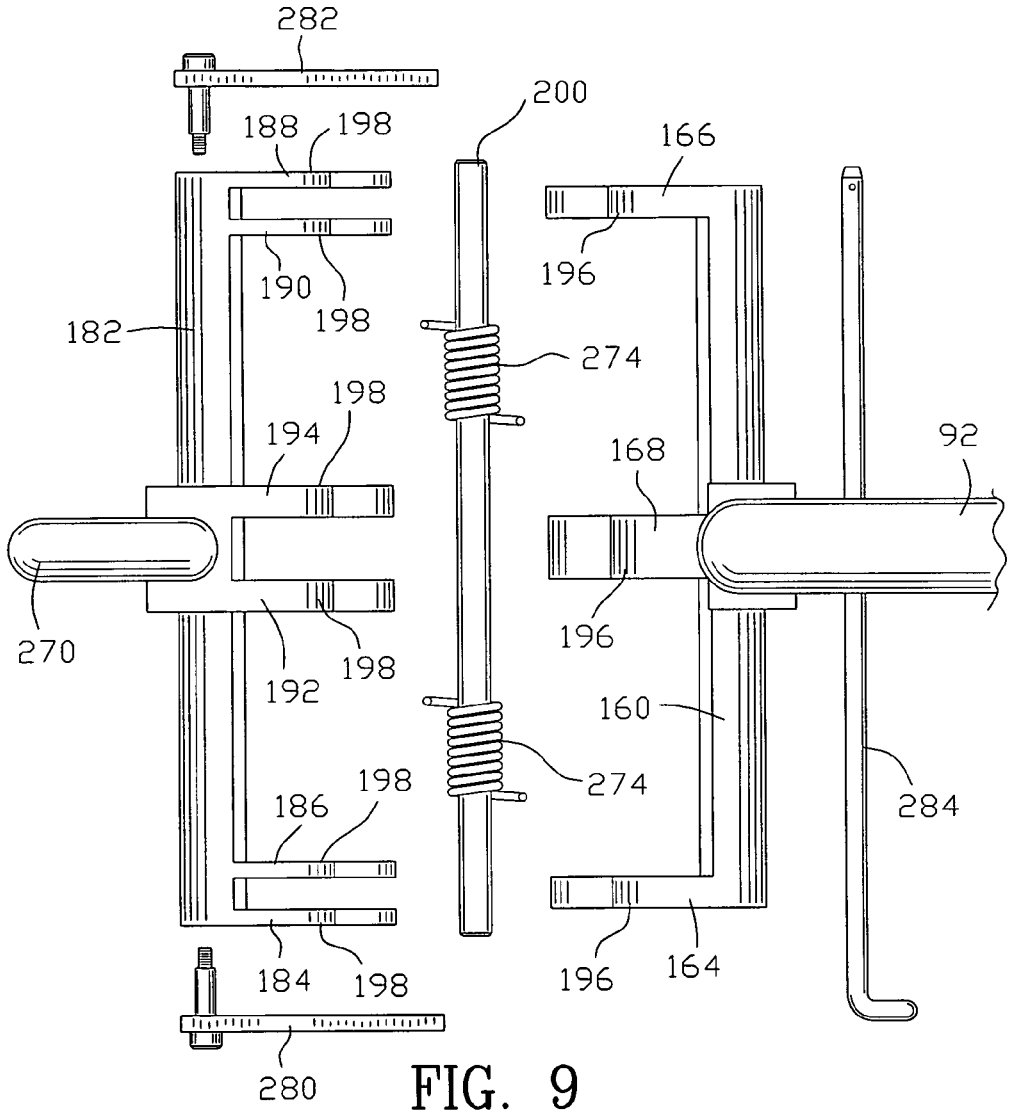
FIG. 9 is an exploded view of a portion of FIG. 3 illustrating a first clamp.
Figure 10:
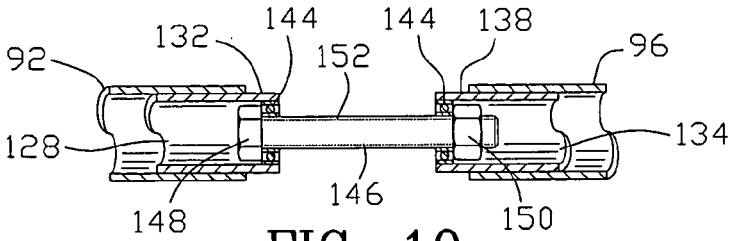
FIG. 10 is a sectional view along line 10-10 in FIG. 3.
Figure 11:
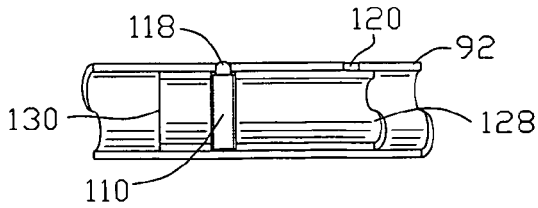
FIG. 11 is a sectional view along line 11-11 in FIG. 3.
Figure 12:
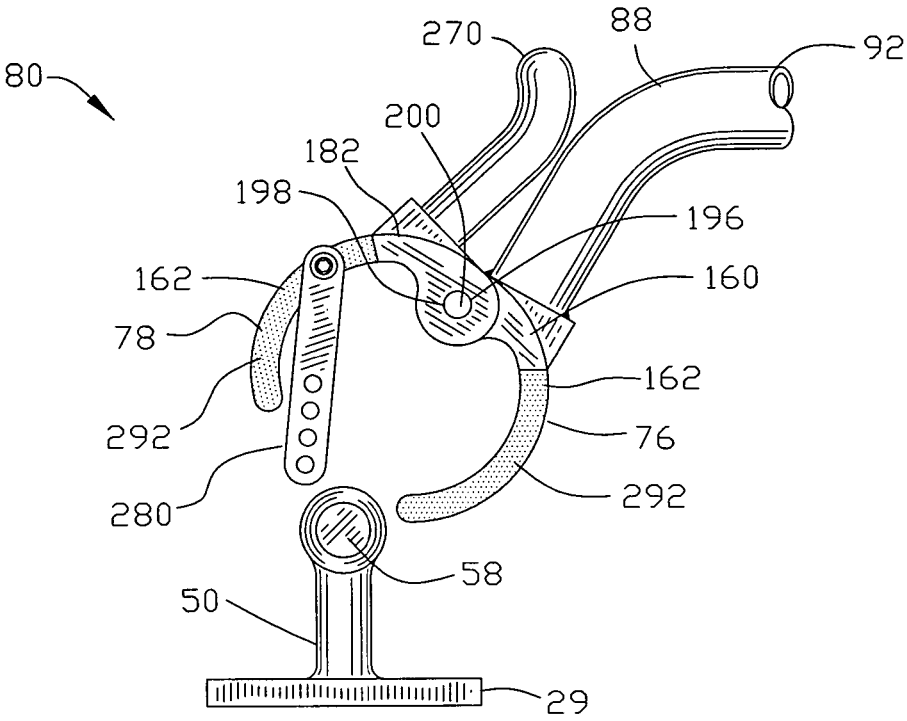
FIG. 12 is an enlarged view of a portion of FIG. 4 illustrating the first clamp disengaged for receiving a cleat.
Figure 13:
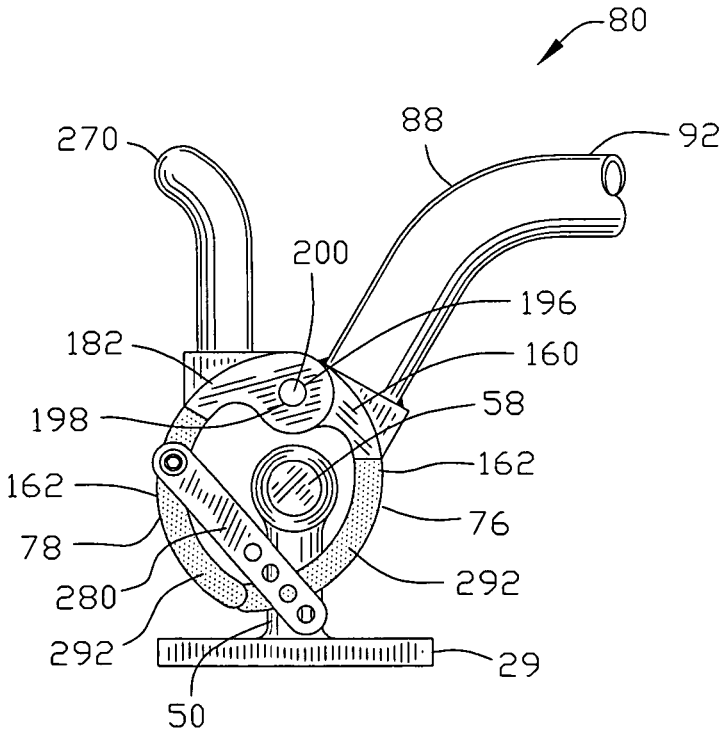
FIG. 13 is a view similar to FIG. 12 illustrating the first clamp engaged with the cleat.
Figure 14:
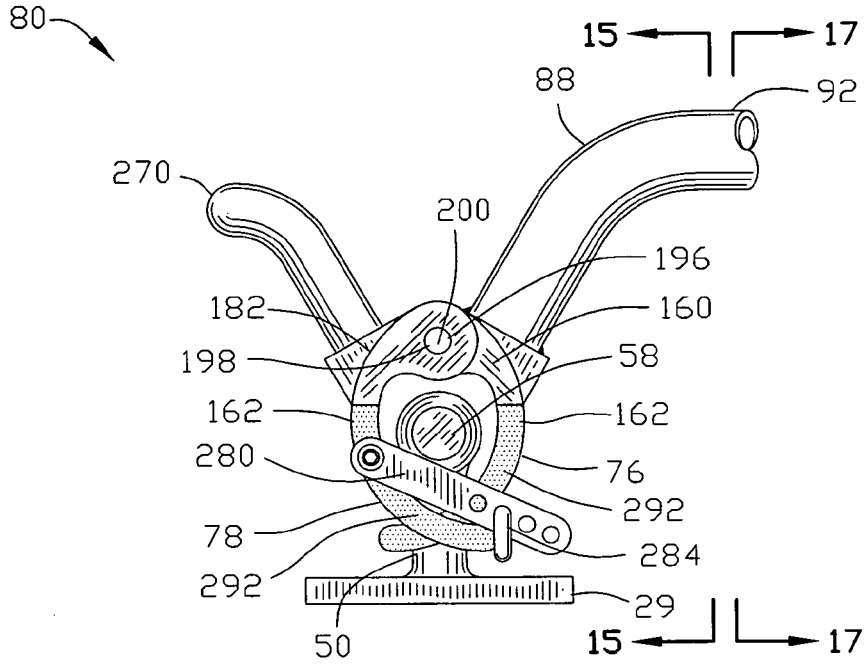
FIG. 14 is a view similar to FIG. 13 illustrating the first clamp locked to the cleat.
Figure 15:
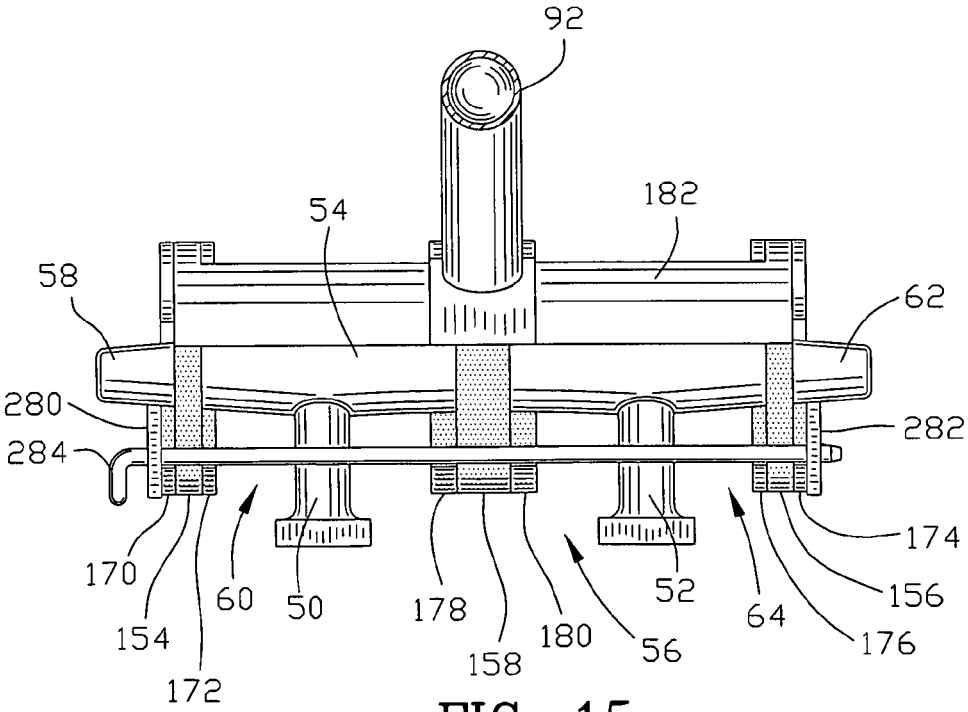
FIG. 15 a sectional view along line 15-15 in FIG. 14.

As best seen in FIGS. 9 and 15, the first plurality of fingers 76 include primary finger 154, a secondary finger 156 and a central finger 158 coupled by a first beam 160. The primary finger 154, the secondary finger 156 and the central finger 158 of the first plurality of fingers 76 has an arcuate bend 162 for traversing the second channel 60, the third channel 64 and the first channel 56 of the first cleat 30 respectively. The first beam 160 has a primary pivot arm 164, a secondary pivot arm 166 and a central pivot arm 168 positioned above the primary finger 154, the secondary finger 156 and the central finger 158.

The second plurality of fingers 78 includes a major primary finger 170, a minor primary finger 172, a major secondary finger 174, a minor secondary finger 176, a major central finger 178 and a minor central finger 180 coupled by a second beam 182. The major primary finger 170 and the minor primary finger 172, the major secondary finger 174 and the minor secondary finger 176, the major central finger 178 and the minor central finger 180 have an arcuate bend 162 for traversing the second channel 60, the third channel 64 and the first channel 56 of the first cleat 30 respectively.

The second beam 182 has a major primary pivot arm 184 and a minor primary pivot arm 186, a major secondary pivot arm 188 and a minor secondary pivot arm 190, a major central pivot arm 192 and a minor central pivot arm 194 positioned above the major primary finger 170 and the minor primary finger 172, the major secondary finger 174 and the minor secondary finger 176, the major central finger 178 and the minor central finger 180 respectively.

A first pin bore 196 traverses the primary pivot arm 164, the secondary pivot arm 166 and the central pivot arm 168 of the first beam 160. A second pin bore 198 traverses the major primary pivot arm 184 and the minor primary pivot arm 186, the major secondary pivot arm 188 and the minor secondary pivot arm 190, the major central pivot arm 192 and the minor central pivot arm 194 of the second beam 182.

The primary pivot arm 164, the secondary pivot arm 166 and the central pivot arm 168 of the first beam 160 are inserted between the major primary pivot arm 184 and the minor primary pivot arm 186, the major secondary pivot arm 188 and the minor secondary pivot arm 190, the major central pivot arm 192 and the minor central pivot arm 194 of the second beam 182 respectively. A first clamp pin 200 traverses the first pin bore 196 and the second pin bore 198 for pivoting the second plurality of fingers 78 relative to the first plurality of fingers 76.

The third plurality of fingers 82 includes primary finger 214, a secondary finger 216 and a central finger 218 coupled by a third beam 220. The primary finger 214, the secondary finger 216 and the central finger 218 of the third plurality of fingers 82 have an arcuate bend 222 for traversing the second channel 60, the third channel 64 and the first channel 56 of the second cleat 40 respectively. The third beam 220 has a primary pivot arm 224, a secondary pivot arm 226 and a central pivot arm 228 positioned above the primary finger 214, the secondary finger 216 and the central finger 218. The fourth plurality of fingers 84 includes a major primary finger 230, a minor primary finger 232, a major secondary finger 234, a minor secondary finger 236, a major central finger 238 and a minor central finger 240 coupled by a fourth beam 242.

The major primary finger 230 and the minor primary finger 232, the major secondary finger 234 and the minor secondary finger 236, the major central finger 238 and the minor central finger 240 has an arcuate bend 222 for traversing the second channel 60, the third channel 64 and the first channel 56 of the second cleat 40 respectively. The fourth beam 242 has a major primary pivot arm 244 and a minor primary pivot arm 246, a major secondary pivot arm 248 and a minor secondary pivot arm 250, a major central pivot arm 252 and a minor central pivot arm 254 positioned above the major primary finger 230 and the minor primary finger 232, the major secondary finger 234 and the minor secondary finger 236, the major central finger 238 and the minor central finger 240 respectively.

A third pin bore 256 traversing the primary pivot arm 224, the secondary pivot arm 226 and the central pivot arm 228 of the third beam 220. A fourth pin bore 258 traverses the major primary pivot arm 244 and the minor primary pivot arm 246, the major secondary pivot arm 248 and the minor secondary pivot arm 250, the major central pivot arm 252 and the minor central pivot arm 254 of the fourth beam 242. The primary pivot arm 224, the secondary pivot arm 226 and the central pivot arm 228 of the third beam 220 are inserted between the major primary pivot arm 244 and the minor primary pivot arm 246, the major secondary pivot arm 248 and the minor secondary pivot arm 250, the major central pivot arm 252 and the minor central pivot arm 254 of the fourth beam 242 respectively. A second clamp pin 260 traverses the third pin bore 256 and the fourth pin bore 258 for pivoting the fourth plurality of fingers 84 relative to the third plurality of fingers 82.

The second plurality of fingers 78 include a first lever arm 270 for assisting in pivoting the second plurality of fingers 78 about said proximal end 72 of said bar 70. The fourth plurality of fingers 84 includes a second lever arm 272 for assisting in pivoting the fourth plurality of fingers 84 about said distal end 74 of said bar 70.

A first rod spring 274 encircles the first clamp pin 200 and engages between the first plurality of fingers 76 and the second plurality of fingers 78 for biasing the second plurality of fingers 78 into an interlocking position with the first plurality of fingers 76. Similarly, a second rod spring 276 encircles the second clamp pin 260 and engages between the third plurality of fingers 82 and the fourth plurality of fingers 84 for biasing the fourth plurality of fingers 84 into an interlocking position with the third plurality of fingers 82.

In another embodiment of the invention, a first lock bracket 280 is pivotably mounted to the second plurality of fingers 78 and traverses the second channel 60 of the first cleat 30. A second lock bracket 282 is pivotably mounted to the second plurality of fingers 78 and traverses the third channel 64 of the first cleat 30.

A first lock pin 284 traverses from the first lock bracket 280, behind the first plurality of fingers 76 and traverses the second lock bracket 282 for retaining the first plurality of fingers 76 and the second plurality of fingers 78 in an interlocking position. A third lock bracket 286 is pivotably mounted to the fourth plurality of fingers 84 and traverses the second channel 60 of the second cleat 40. A fourth lock bracket 288 is pivotably mounted to the fourth plurality of fingers 84 and traverses the third channel 64 of the second cleat 40. A second lock pin 290 traverses from the third lock bracket 286, behind the third plurality of fingers 82 and traverses the fourth lock bracket 288 for retaining the third plurality of fingers 82 and the fourth plurality of fingers 84 in an interlocking position.

The first plurality of fingers 76 and the second plurality of fingers 78, the third plurality of fingers 82 and the fourth plurality of fingers 84 may include a polymeric coating 292 for preventing scaring of the first cleat 30 and the second cleat 40 respectively.

Figure 18:
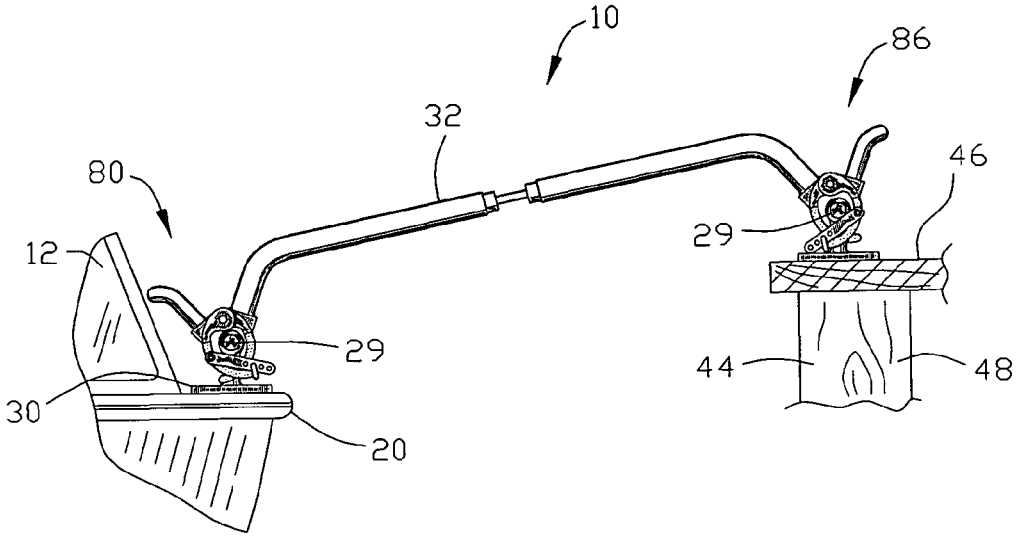
FIG. 18 is a view similar to FIG. 4 illustrating the mooring device securing a first boat to a dock.
Figure 19:
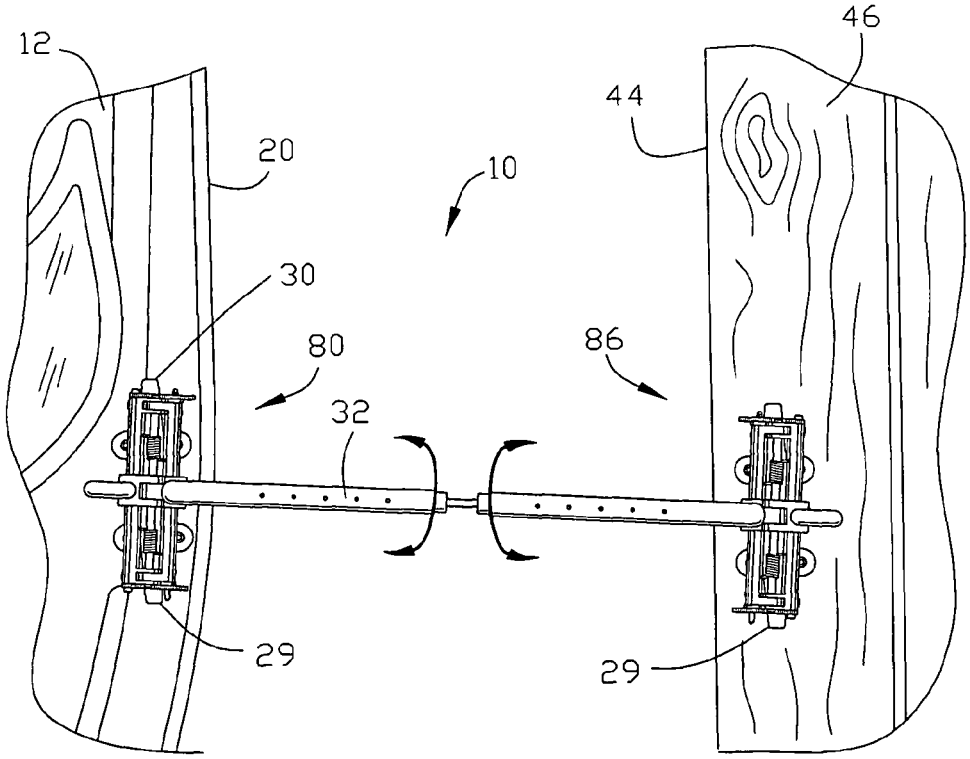
FIG. 19 is a top view of FIG. 18.
Figure 20:
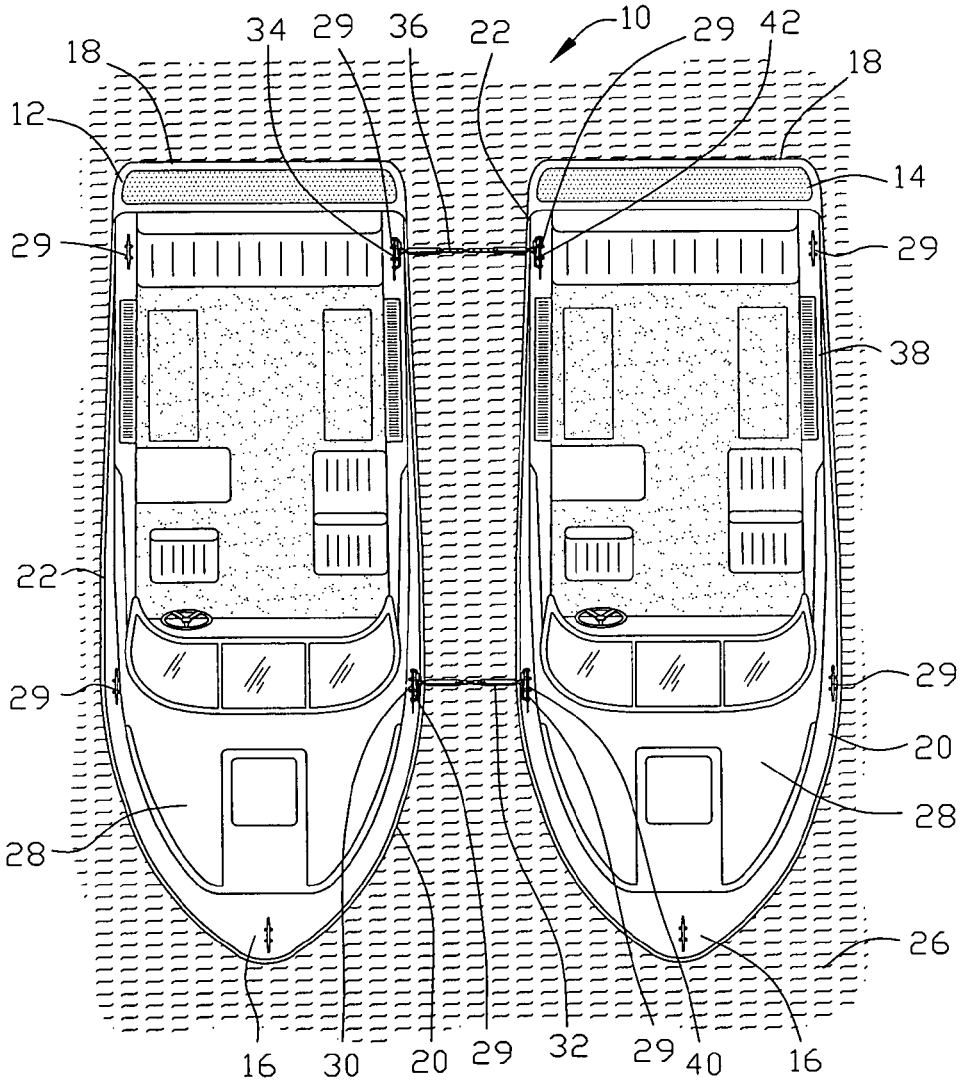
FIG. 20 is a top view of a second embodiment of a mooring device of the present invention securing a first boat to a second boat.
Figure 21:
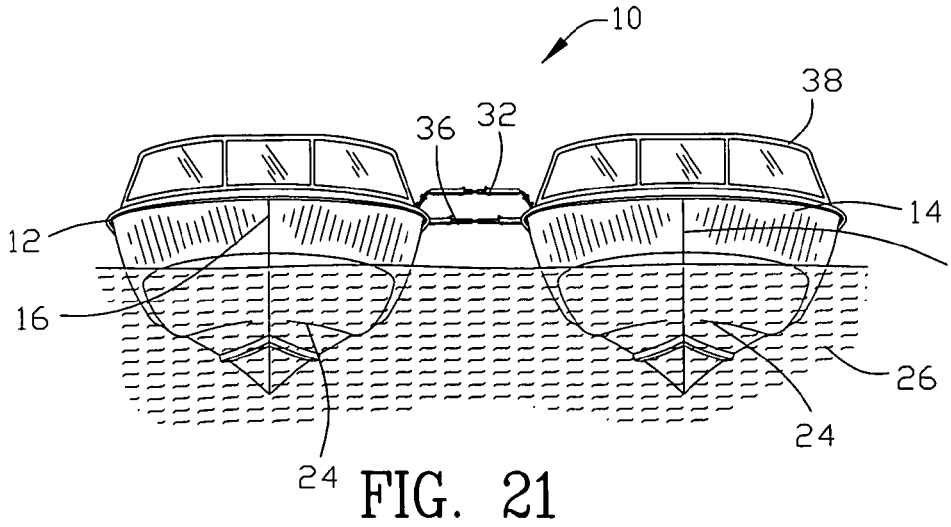
FIG. 21 is a front view of FIG. 20.
Figure 22:
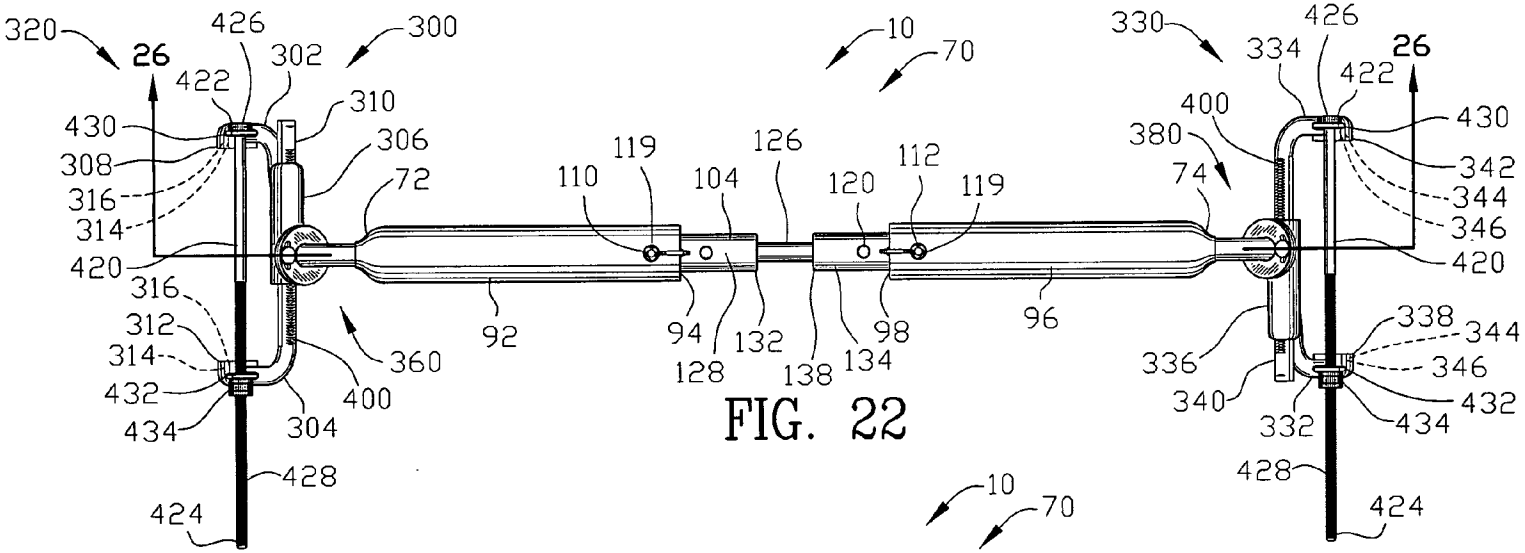
FIG. 22 is a top view of the mooring device of FIG. 20.
Figure 23:
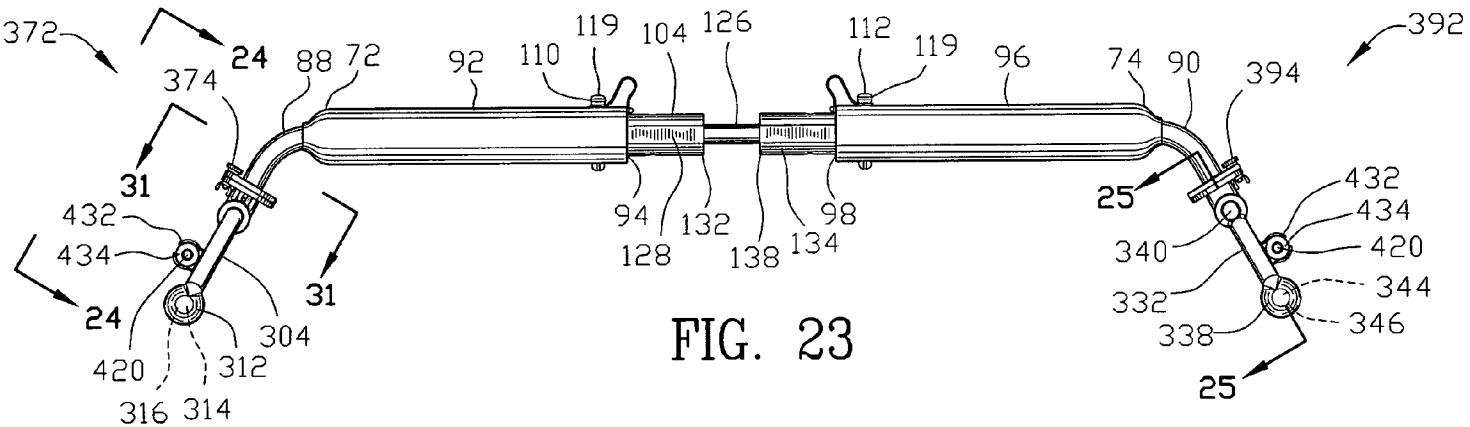
FIG. 23 is a front view of FIG. 22.
Figure 24:
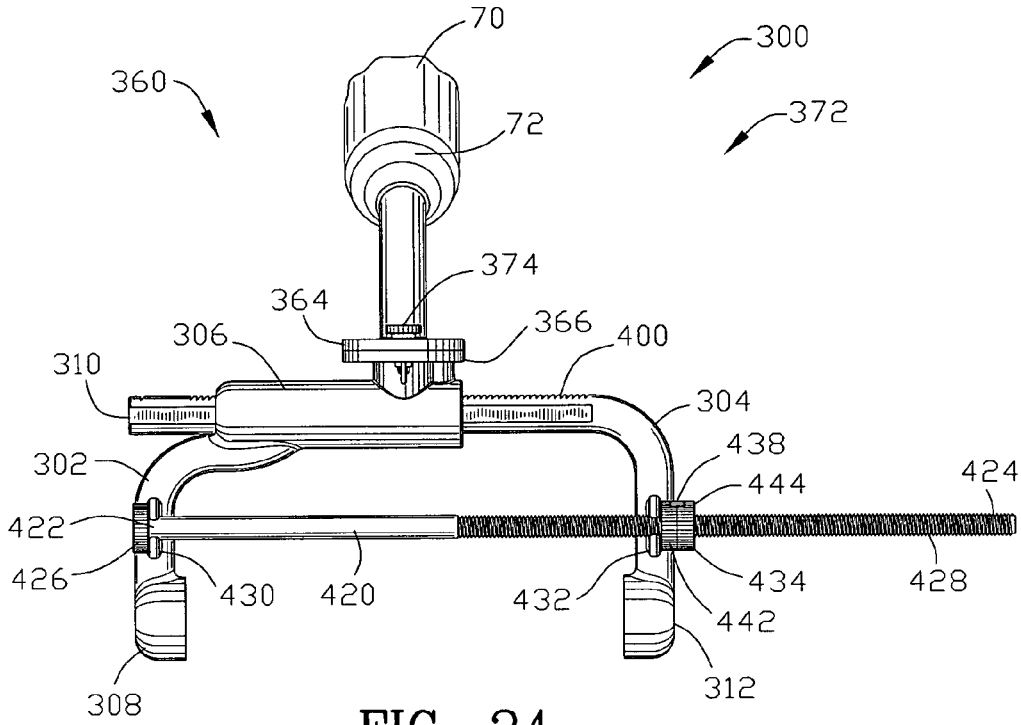
FIG. 24 is a left side view of FIG. 23.

The mooring device 10 facilitates the prompt and reliable linkage between the boat 12 and the object 14. As illustrated in FIGS. 18 and 19 the first clamp 80 and the second clamp 86 permit rotation about the first cleat 30 and the second cleat 40 respectively. This rotation of the first clamp 80 and the second clamp 86 about the first cleat 30 and the second cleat 40 respectively allows for the boat 12 to be displaced in a vertical orientation relative to the object 14 without damaging the mooring device 10, the boat 12, the object 14, the first cleat 30 or the second cleat 40. As best seen in FIG. 19, the mooring device 10 maintains the horizontal alignment between the boat 12 and the object 14 wherein the mooring device 10 is wedged against the first cleat 30. As illustrated in FIGS. 1 and 2, a first mooring device 32 may be used in conjunction with a second mooring device 36 to maintain the parallel alignment between a first boat 12 and a second boat 38. Furthermore, a first mooring device 32 may be used in conjunction with a second mooring device 36 to maintain the parallel alignment between the boat 12 and the dock 44.

FIGS. 20-40 illustrate another embodiment of the mooring device 10 incorporating the subject invention. In FIGS. 20-40 the mooring device 10 engages and pivots upon the first cleat end 66 and the second cleat end 68 of the first cleat 30 and the second cleat 40. A first C-clamp 300 is secured to the proximal end 72 of the bar 70 for engaging the first cleat 30 to the bar 70. The first C-clamp 300 includes a primary C-clamp arm 302 and a secondary C-clamp arm 304. The primary C-clamp arm 302 of the first C-clamp 300 extends between a major cylindrical channel 306 and a major cleat socket 308. The secondary C-clamp arm 304 of the first C-clamp 300 extends between a minor rod 310 and a minor cleat socket 312. The minor rod 310 of the secondary C-clamp arm 304 of the first C-clamp 300 slidably engages within the major cylindrical channel 306 of the primary C-clamp arm 302 of the first C-clamp 300 for adjusting the distance between the major cleat socket 308 and the minor cleat socket 312 of the first C-clamp 300.

A first C-clamp stop 320 locks the secondary C-clamp arm 304 of the first C-clamp 300 relative to the primary C-clamp arm 302 of the first C-clamp 300 for terminating displacement between the major cleat socket 308 and the minor cleat socket 312 of the first C-clamp 300. The major cleat socket 308 and the minor cleat socket 312 of the first C-clamp 300 engage the first cleat end 66 and the second cleat end 68 of the first cleat 30 respectively upon the minor rod 310 of the secondary C-clamp arm 304 of the first C-clamp 300 slidably engaging within the major cylindrical channel 306 of the primary C-clamp arm 302 of the first C-clamp 300 for securing the first cleat 30 to the bar 70 and defining a first cleat pivot 322. The first cleat pivot 322 permits the first C-clamp 300 to pivot relative to the first cleat 30.

A second C-clamp 330 is secured to the distal end 74 of the bar 70 for engages the second cleat 40 to the bar 70. The second C-clamp 330 includes a primary C-clamp arm 332 and a secondary C-clamp arm 334. The primary C-clamp arm 332 of the second C-clamp 330 extends between a major cylindrical channel 336 and a major cleat socket 338. The secondary C-clamp arm 334 of the second C-clamp 330 extends between a minor rod 340 and a minor cleat socket 342. The minor rod 340 of the secondary C-clamp arm 334 of the second C-clamp 330 slidably engages within the major cylindrical channel 336 of the primary C-clamp arm 332 of the second C-clamp 330 for adjusting the distance between the major cleat socket 338 and the minor cleat socket 342 of the second C-clamp 330.

A second C-clamp stop 350 locks the secondary C-clamp arm 334 of the second C-clamp 330 relative to the primary C-clamp arm 332 of the second C-clamp 330 for terminating displacement between the major cleat socket 338 and the minor cleat socket 342 of the second C-clamp 330. The major cleat socket 338 and the minor cleat socket 342 of the second C-clamp 330 engage the first cleat end 66 and the second cleat end 68 of the second cleat 40 respectively upon the minor rod 340 of the secondary C-clamp arm 334 of the second C-clamp 330 slidably engaging within the major cylindrical channel 336 of the primary C-clamp arm 332 of the second C-clamp 330 for securing the second cleat 40 to the bar 70 and defining a second cleat pivot 352. The second cleat pivot 352 permits the second C-clamp 330 to pivot relative to the second cleat 40.

Figure 25:
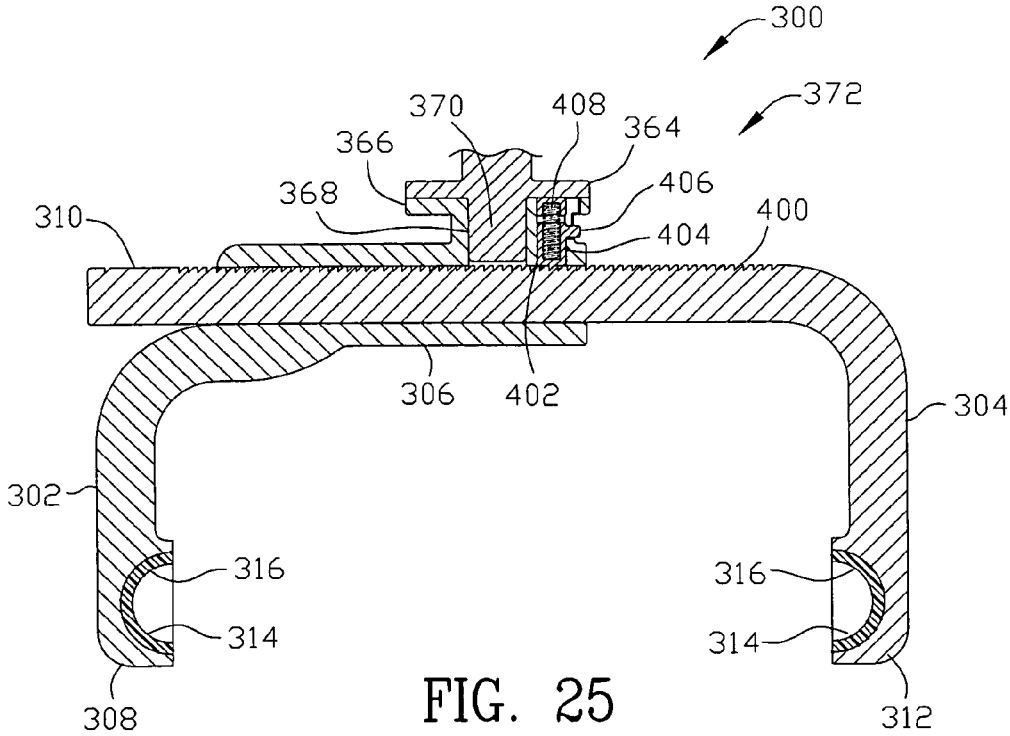
FIG. 25 is a sectional view along line 25-25 in FIG. 23.
Figure 26:
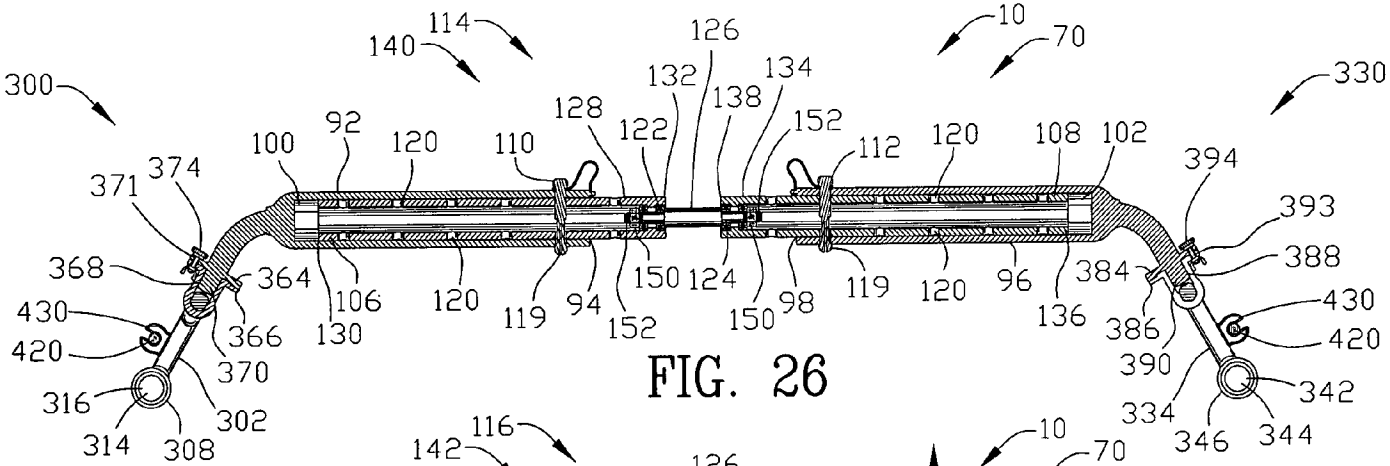
FIG. 26 is a sectional view along line 26-26 in FIG. 22.
Figure 27:
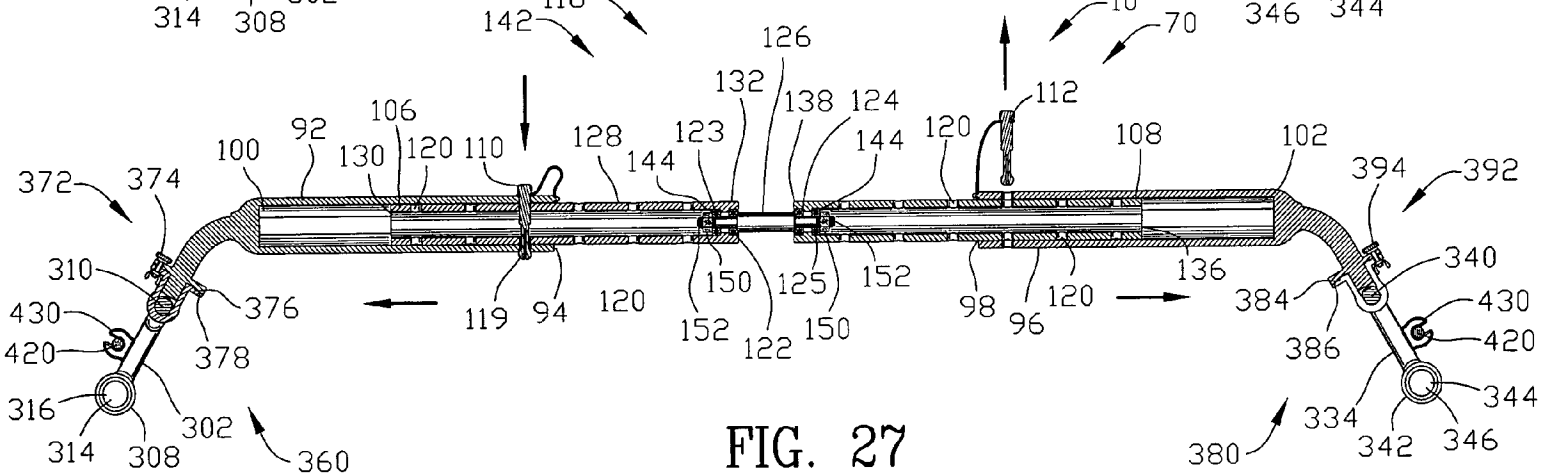
FIG. 27 is a view similar to FIG. 26 illustrating a first telescoping bar and a second telescoping bar being lengthened.
Figure 28:
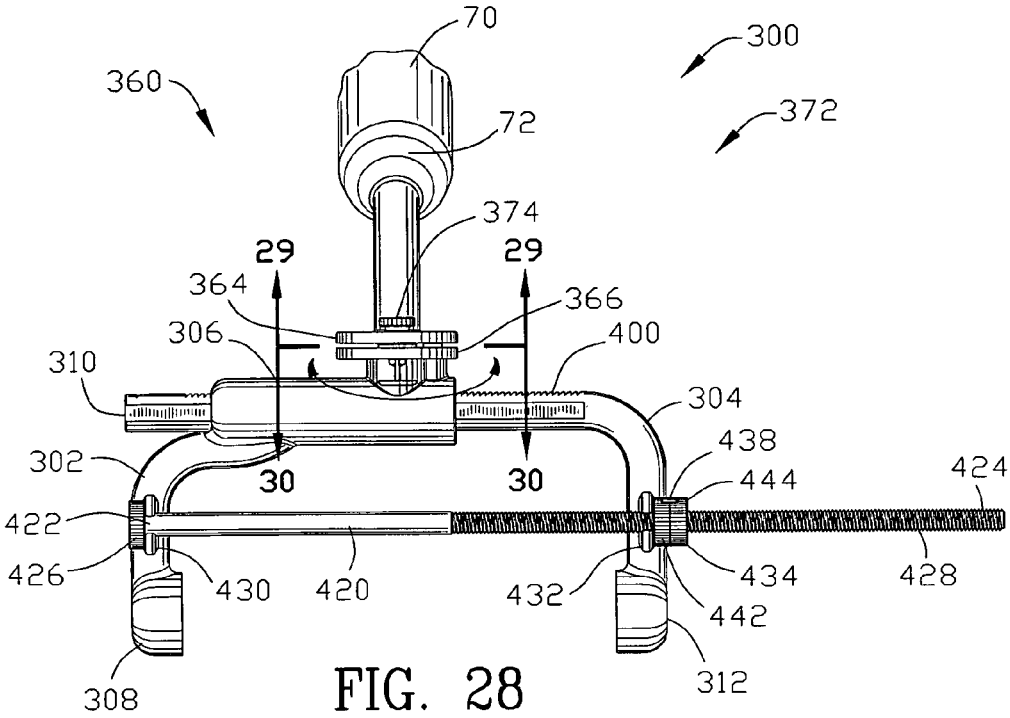
FIG. 28 is a view similar to FIG. 24 illustrating the first telescoping bar being pivotable relative to a first C-clamp.
Figure 29:
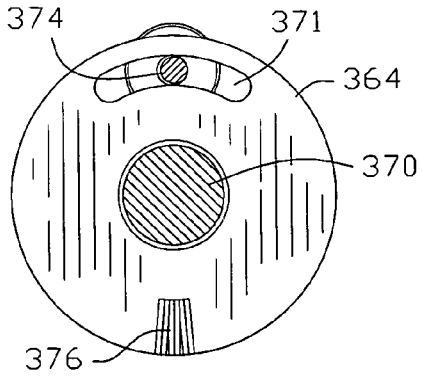
FIG. 29 is a sectional view along line 29-29 in FIG. 28.
Figure 30:
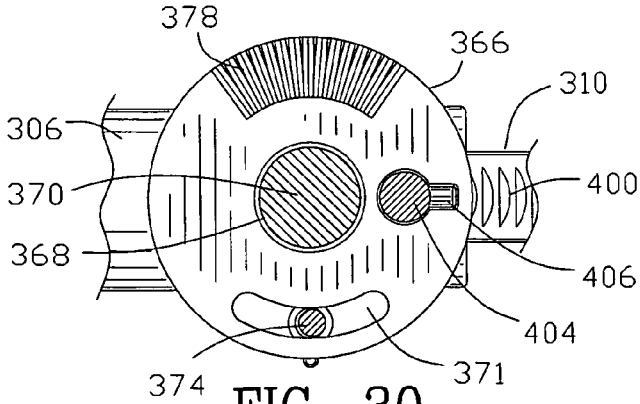
FIG. 30 is a sectional view along line 30-30 in FIG. 28.
Figure 31:
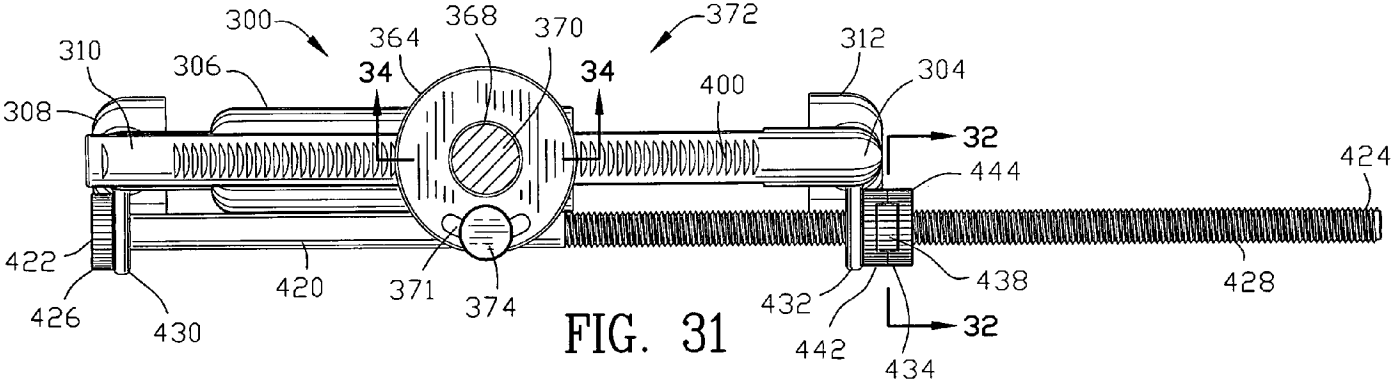
FIG. 31 is a sectional view along line 31-31 in FIG. 23.
Figure 33:
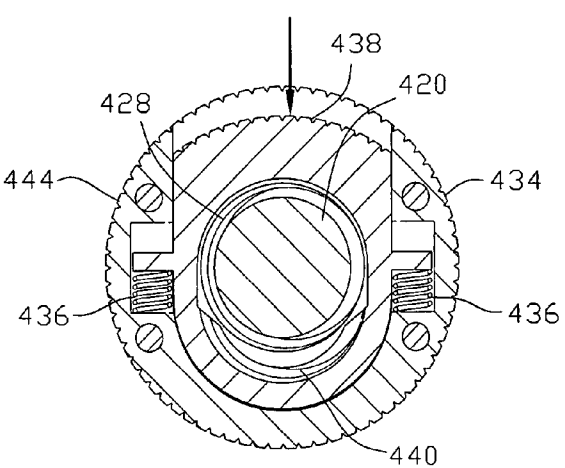
FIG. 33 is a view similar to FIG. 32 illustrating a compressive force being applied to a first C-clamp nut.
Figure 32:
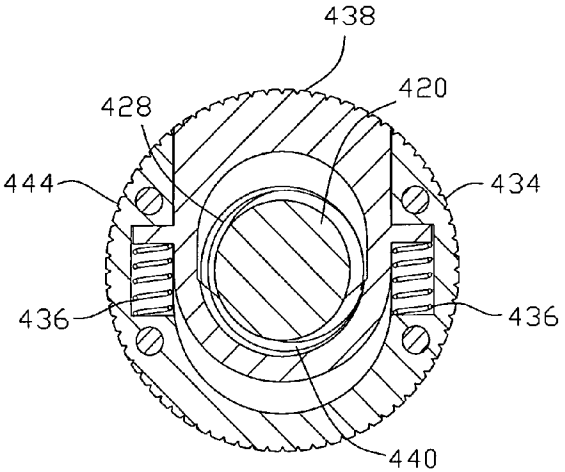
FIG. 32 is a sectional view along line 32-32 in FIG. 31.

As best seen in FIG. 15, the first and second cleats 30, 34, 40 and 42 include a first cleat end 66 and a second cleat end 68. The first and second cleat ends 66 and 68 may have a generally convex shape 69. As seen in FIG. 25, in order to increase the contact surface area between the first and second cleats 30, 34, 40 and 42 and the mooring device 10, the major cleat socket 308 and the minor cleat socket 312 of the first C-clamp 300 may include a first concave receiver 314 for conforming to the first cleat end 66 and the second cleat end 68 of the first cleats 30 and 34 respectively. Similarly, the major cleat socket 338 and the minor cleat socket 342 of the second C-clamp 330 may include a second concave receiver 344 for conforming to the first cleat end 66 and the second cleat end 68 of the second cleats 40 and 42 respectively.

The first concave receiver 314 may include a first polymeric concave layer 316 for deforming upon contact between the first concave receiver 314 and the first cleat end 66 and the second cleat end 68 of the first cleats 30 and 34 respectively. The deformation of the first polymeric concave layer 316 increases the contact surface area between the first cleat end 66 and the second cleat end 68 and the major cleat socket 308 and the minor cleat socket 312.

The second concave receiver 344 may include a second polymeric concave layer 346 for deforming upon contact between the second concave receiver 344 and the first cleat end 66 and the second cleat end 68 of the second cleats 40 and 42 respectively. The deformation of the second polymeric concave layer 346 increases the contact surface area between the first cleat end 66 and the second cleat end 68 and the major cleat socket 338 and the minor cleat socket 342.

The mooring device 10 as shown in FIGS. 20-40, may include a first C-clamp pivot 360 for pivotably securing the proximal end 72 of the bar 70 to the first C-clamp 300 for altering a first angle 362 between the first C-clamp 300 and the bar 70. The first C-clamp pivot 360 includes a first upper plate 364 secured to the proximal end 72 of the bar 70. A first lower plate 366 is secured to the major cylindrical channel 306 of the first C-clamp 300 by a first pivot bore 368. A first pivot pin 370 extends from the first upper plate 364 for insertion and pivoting within the first pivot bore 368. The first upper plate 364 and the first lower plate 366 make contact for terminating insertion of the first pivot pin 370 within the first pivot bore 368. The first upper plate 364 pivots relative to the first lower plate 366.

A first C-clamp pivot lock 372 engages the first C-clamp pivot 360 for terminating pivoting of the proximal end 72 of the bar 70 relative to the first C-clamp 300. The first C-clamp pivot lock 372 includes a first arcuate groove 371 positioned within the first upper plate 364 and the first lower plate 366 for receiving a first upper lock fastener 374. The first upper lock fastener 374 applies a compressive force between the first upper plate 364 and the first lower plate 366 for resisting pivoting of the first upper plate 364 relative to the first lower plate 366. The first upper plate 364 may include a first upper plurality of teeth 376 for abutting the first lower plate 366. The first lower plate 366 may include a first lower plurality of teeth 378 for abutting the first upper plate 364. The first upper plurality of teeth 376 engage with the first lower plurality of teeth 378 for preventing rotation of the first upper plate 364 relative to the first lower plate 366.

A second C-clamp pivot 380 pivotably securing the distal end 74 of the bar 70 to the second C-clamp 380 for altering a second angle 382 between the second C-clamp 380 and the bar 70. The second C-clamp pivot 380 includes a second upper plate 384 secured to the distal end 74 of the bar 70. A second lower plate 386 is secured to the major cylindrical channel 336 of the second C-clamp 380 by a second pivot bore 388. A second pivot pin 390 extends from the second upper plate 384 for insertion and pivoting within the second pivot bore 388. The second upper plate 384 and the second lower plate 386 make contact for terminating insertion of the second pivot pin 390 within the second pivot bore 388. The second upper plate 384 pivots relative to the second lower plate 386.

A second C-clamp pivot lock 392 engages the second C-clamp pivot 380 for terminating pivoting of the distal end 74 of the bar 70 relative to the second C-clamp 330. The second C-clamp pivot lock 392 includes a second arcuate groove 393 positioned within the second upper plate 384 and the second lower plate 386 for receiving a second upper lock fastener 394. The first upper lock fastener 394 applies a compressive force between the second upper plate 384 and the second lower plate 386 for resisting pivoting of the second upper plate 384 relative to the second lower plate 386. The second upper plate 384 may include a second upper plurality of teeth 396 for abutting the second lower plate 386. The second lower plate 386 may include a second lower plurality of teeth 398 for abutting the second upper plate 384. The second upper plurality of teeth 396 engage with the second lower plurality of teeth 398 for preventing rotation of the second upper plate 384 relative to the second lower plate 386.

Figure 34:
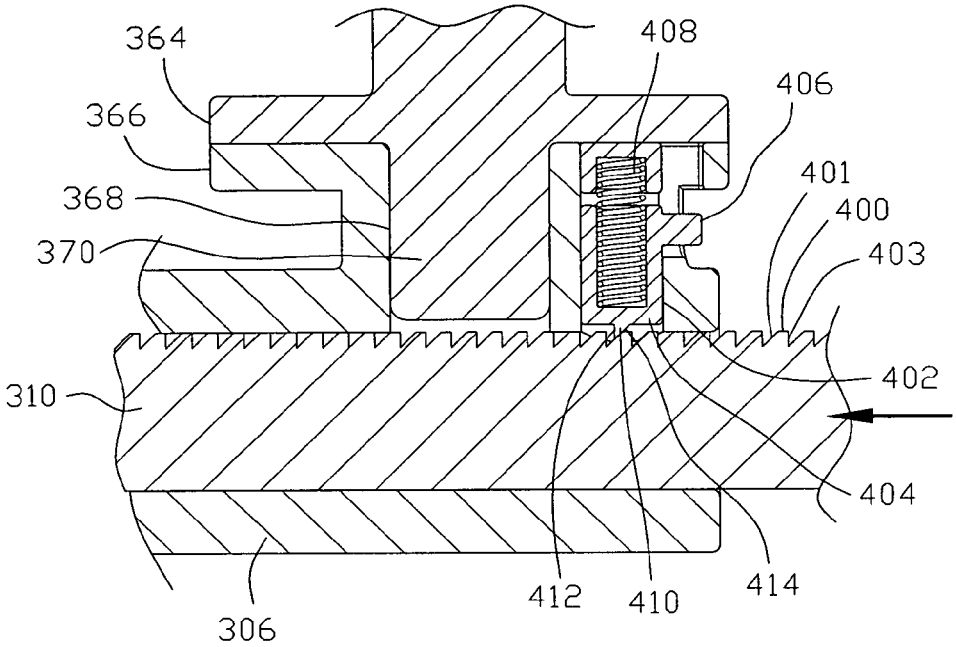
FIG. 34 is a sectional view along line 34-34 in FIG. 31 illustrating a compressive force being applied to the first C-clamp.
Figure 35:
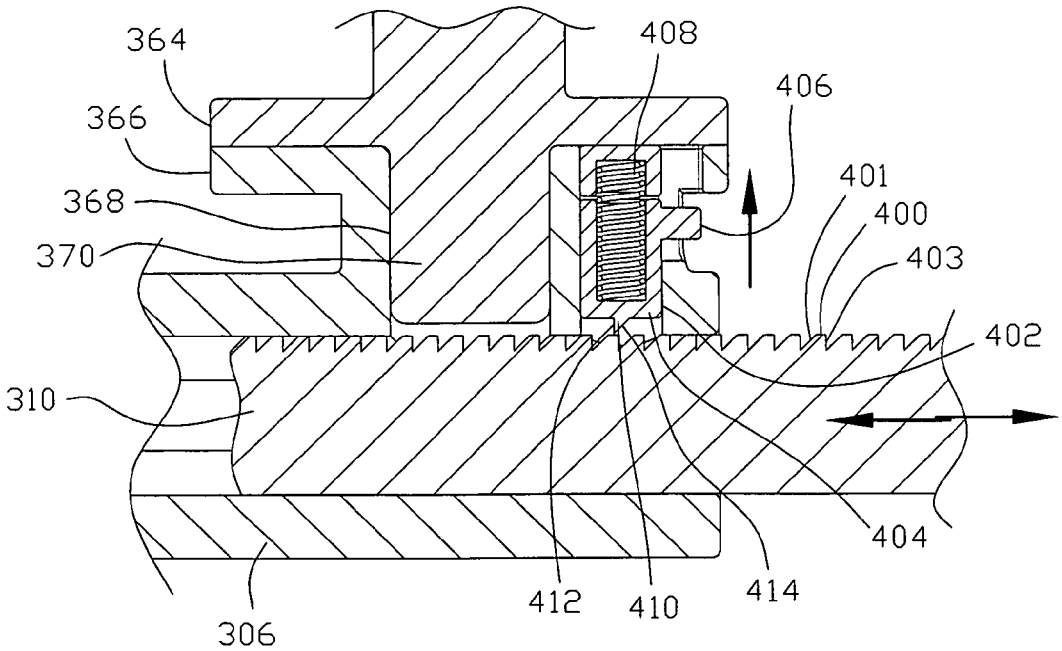
FIG. 35 is a view similar to FIG. 34 illustrating an expansion force applied to the first C-clamp and an ascending force applied to a first finger ratchet.
Figure 36:
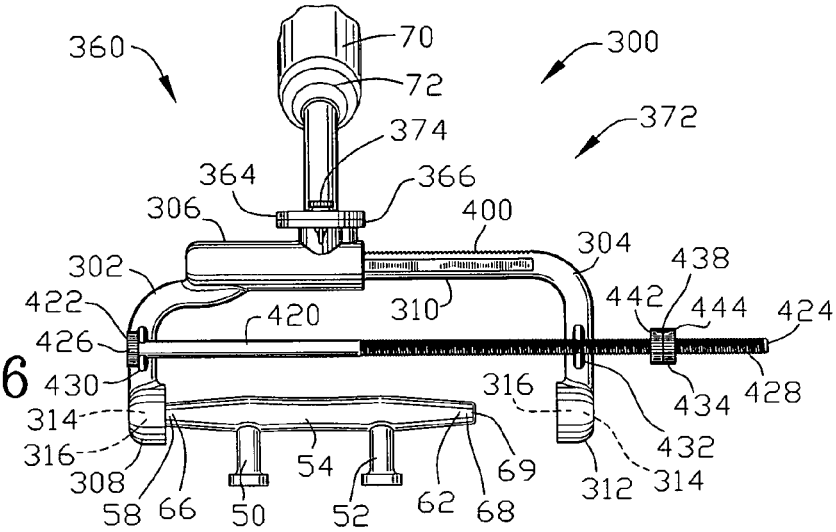
FIG. 36 is a view similar to FIG. 24 illustrating a first clamp arm of the first C-clamp engaging the cleat.
Figure 37:
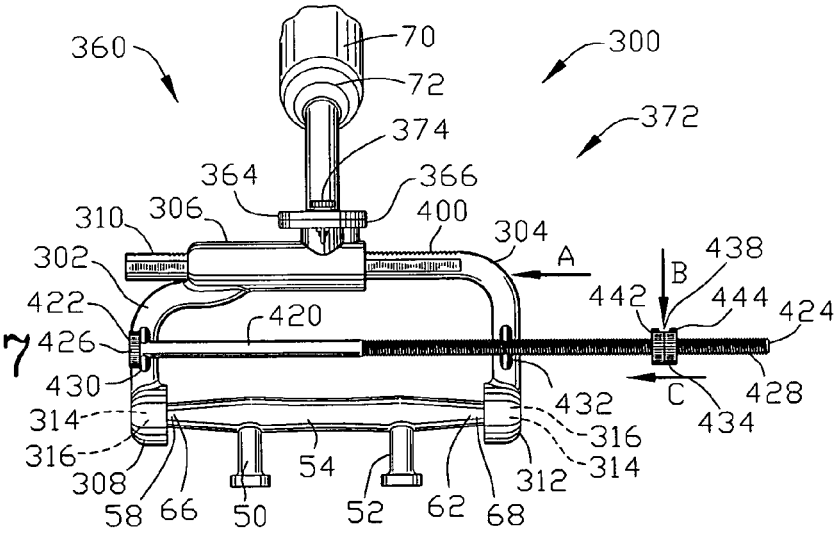
FIG. 37 is a view similar to FIG. 36 illustrating a second clamp arm of the first C-clamp engaging the cleat.
Figure 38:
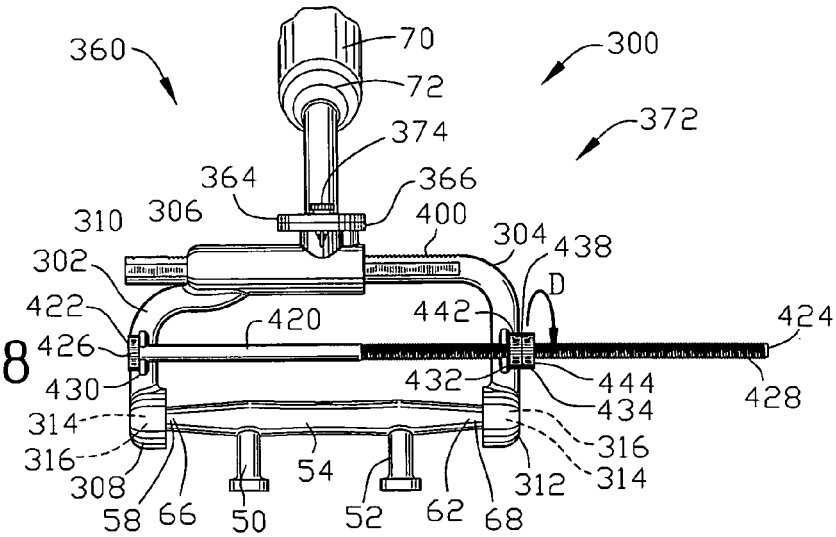
FIG. 38 is a view similar to FIG. 37 illustrating the first C-clamp nut threadably engaging a first C-clamp bolt.
Figure 39:
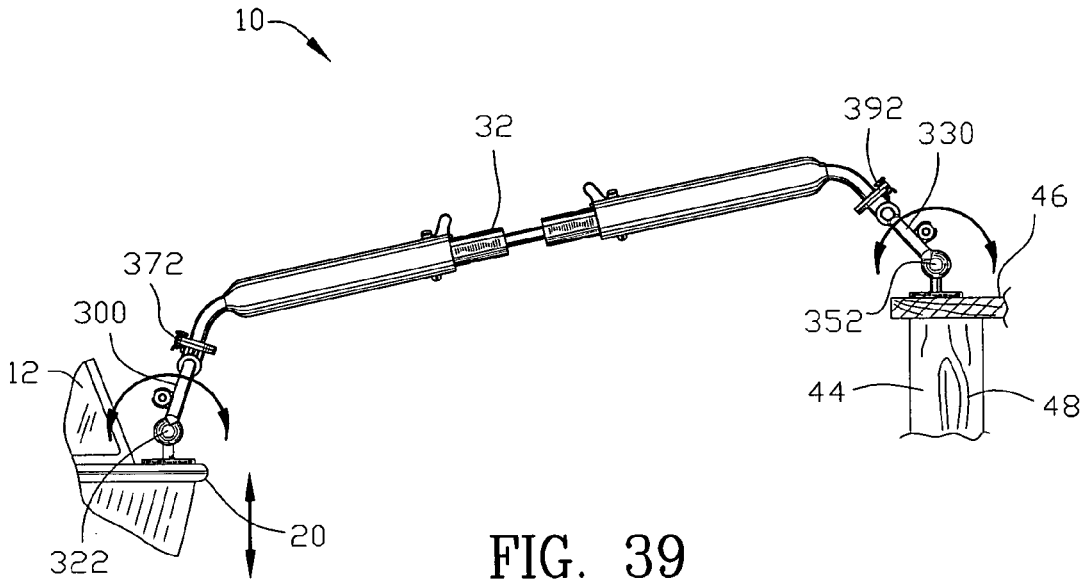
FIG. 39 is a view similar to FIG. 4 illustrating the second mooring device securing the first boat to the dock.
Figure 40:
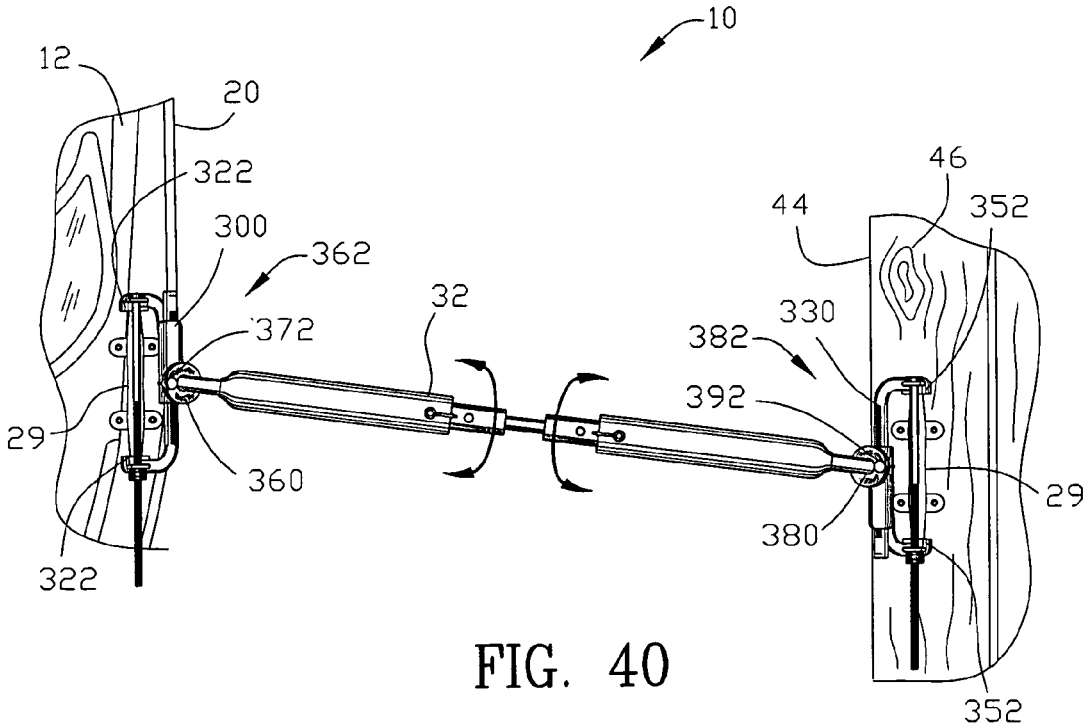
FIG. 40 is a top view of FIG. 39.

As best seen in FIGS. 25, 34 and 35, the first C-clamp stop 320 and the second C-clamp stop 350 may include a plurality of ribs 400 integral to the minor rod 310 of the secondary C-clamp arm 304 of the first C-clamp 300 and second C-clamp stop 350. Each of the plurality of ribs 400 includes a left tapered wall 401 and a right vertical wall 403.

The first C-clamp 300 and second C-clamp stop 350 may include a ratchet bore 402 traversing the major cylindrical channel 306. A finger ratchet 404 slidably engages within the ratchet bore 402. A ratchet handle 406 extends from the finger ratchet 404 to the exterior of the major cylindrical channel 306. The ratchet handle 406 permits a displacement of the finger ratchet 404 within the ratchet bore 402. A ratchet spring 408 is positioned within the ratchet bore 402 for biases the finger ratchet 406 towards the minor rod 310 of the first C-clamp 300 and second C-clamp stop 350. The finger ratchet 406 includes a ratchet tooth 410 for engaging with the plurality of ribs 400. The ratchet tooth 410 includes a left vertical wall 412 and a right tapered wall 414.

The right tapered wall 414 of the ratchet tooth 410 and the left tapered wall 401 of the plurality of ribs 400 permits the ratchet tooth 410 to traverse over each of the plurality of ribs 400 upon the minor rod 310 of the secondary C-clamp arm 304 of the first C-clamp 300 and second C-clamp stop 350 slidably engaging within the major cylindrical channel 306 of the primary C-clamp arm 302 in the direction for converging the major cleat socket 308 with the minor cleat socket 312. Alternatively, the left vertical wall 412 of the first ratchet tooth 410 and the right vertical wall 403 of the plurality of ribs 400 prohibit the ratchet tooth 410 from traversing over the plurality of ribs 400 when the minor rod 310 of the secondary C-clamp arm 304 of the first C-clamp 300 and second C-clamp stop 350 is attempted to be withdrawn from the major cylindrical channel 306 of the primary C-clamp arm 302 in the direction for diverging the major cleat socket 308 with the minor cleat socket 312.

In order to withdraw the minor rod 310 of the secondary C-clamp arm 304 of the first C-clamp 300 and second C-clamp stop 350 from the major cylindrical channel 306 of the primary C-clamp arm 302 in the direction for diverging the major cleat socket 308 with the minor cleat socket 312, the ratchet handle 406 is displaced by an ascending force direction to lift the ratchet tooth 410 above the plurality of ribs 400. Upon the removal of the ascending force upon the ratchet handle 406, the ratchet spring 408 biases the finger ratchet 404 towards the minor rod 310 of the first C-clamp 300 and second C-clamp stop 350.

As best seen in FIGS. 22-27, 31-33 and 36-38, the first C-clamp stop 320 and the second C-clamp stop 350 may alternatively include a C-clamp bolt 420 extending between a first bolt end 422 and a second bolt end 424. The first bolt end 422 of the C-clamp bolt has a head 426 and the second bolt end 424 has a thread 428. The primary C-clamp arm 302 and 332 of the first C-clamp 300 and the second C-clamp 330 includes a first C-bracket 430 for receiving the C-clamp bolt 420. Similarly, the secondary C-clamp arm 304 and 334 of the first C-clamp 300 and the second C-clamp 330 includes a second C-bracket 432 for receiving the C-clamp bolt 420. The head 426 of the first bolt end 422 abuts the first C-bracket 430. A quick release nut 434 threadably engages the thread 428 of the second bolt end 424. The quick release nut 434 threadably engages the thread 428 until the nut 434 abuts the second C-bracket 432 for compressing the primary C-clamp arm 302 and 332 of the first C-clamp 300 and the second C-clamp 330 against the secondary C-clamp arm 304 and 334 of the first C-clamp 300 and the second C-clamp 330 for preventing the diverging of the major cleat socket 308 with the minor cleat socket 312. The quick release nut 434 includes a first collar 442 and a second collar 444 encapsulating a threaded plunger 438. The threaded plunger 438 includes a plunger thread 440 for threadably engaging the thread 428. Upon a compression force applied to the threaded plunger 438, the plunger thread 440 is distance from the thread 428 and the quick release nut 434 may be displacement quickly over the C-clamp bolt 420. Upon removal of the compression force applied to the threaded plunger 438, a plunger return spring 436 biases the threaded plunger such the plunger thread 440 engage the thread 428 to terminate displacement of the quick release nut 434 over the C-clamp bolt 420 and to permit the quick release nut 434 to threadably engage the C-clamp bolt 420.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A mooring device for securing a boat to an object, the boat having a first cleat, the object having a second cleat, the first cleat and the second cleat having a first vertical member and a second vertical member separated by a horizontal member, the first vertical member and the second vertical member and the horizontal member defining a first channel, the first vertical member including a first horn aligned with the horizontal member, the first horn and first vertical member defining a second channel, the second vertical member including a second horn aligned with the horizontal member, the second horn and the second vertical member defining a third channel, the mooring device, comprising:

a bar having a proximal end and a distal end;

a first plurality of fingers integral to said proximal end of said bar for engaging the first channel, the second channel and the third channel of the first cleat;

a second plurality of fingers pivotably engaging said proximal end of said bar for engaging the first channel, the second channel and the third channel of the first cleat;

said first plurality of fingers interlock with said second plurality of fingers for defining a first clamp engaging the first cleat;

a third plurality of fingers integral to said distal end of said bar for engaging the first channel, the second channel and the third channel of the second cleat;

a fourth plurality of fingers pivotably engaging said distal end of said bar for engaging the first channel, the second channel and the third channel of the second cleat;

said third plurality of fingers interlock with said fourth plurality of fingers for defining a second clamp engaging the second cleat; and said first clamp and said second clamp coupling said bar between the first cleat and the second cleat for securing the boat to the object.

2. A mooring device for securing a boat to an object as set forth in claim 1, wherein said proximal end of said bar including a first arcuate bend for positioning said bar above said first clamp;

said distal end of said bar including a second arcuate bend for positioning said bar above said second clamp; and said first arcuate bend aligning with said second arcuate bend for aligning said first clamp and said second clamp.

3. A mooring device for securing a boat to an object as set forth in claim 1, wherein said bar further includes a first cylindrical tube extending from said first clamp to a first aperture and a second cylindrical tube extending from said second clamp to a second aperture;

said first cylindrical tube defining a first interior bore;

said second cylindrical tube defining a second interior bore;

a coupling bar having a proximal end and a distal end;

said proximal end of said coupling bar traversing said first aperture and slidably engaging within said first interior bore of said first cylindrical tube;

said distal end of said coupling bar traversing said second aperture and slidably engaging within said second interior bore of said second cylindrical tube;

a first lock engaging said first cylindrical tube and said coupling bar for terminating displacement of said coupling bar relative to said first cylindrical tube;

a second lock engaging said second cylindrical tube and said coupling bar for terminating displacement of said coupling bar relative to said second cylindrical tube;

said first cylindrical tube and said second cylindrical tube and said coupling bar defining a first length between said first clamp and said second clamp; and said displacement of said coupling bar relative to said first cylindrical tube and said second cylindrical tube defining a second length between said first clamp and said second clamp.

4. A mooring device for securing a boat to an object as set forth in claim 1, wherein said bar further includes a first cylindrical tube extending from said first clamp to a first aperture and a second cylindrical tube extending from said second clamp to a second aperture;

said first cylindrical tube defining a first interior bore;

said second cylindrical tube defining a second interior bore;

a first bearing secured to said first aperture of said first cylindrical tube;

a second bearing secured to said second aperture of said second cylindrical tube; and a pin extending between said first bearing and said second bearing for pivoting said first clamp relative to said second clamp.

5. A mooring device for securing a boat to an object as set forth in claim 1, wherein said bar further includes a first cylindrical tube extending from said first clamp to a first aperture and a second cylindrical tube extending from said second clamp to a second aperture;

said first cylindrical tube defining a first interior bore;

said second cylindrical tube defining a second interior bore;

a first coupling bar having a proximal end and a distal end;

said proximal end of said first coupling bar traversing said first aperture and slidably engaging within said first interior bore of said first cylindrical tube;

a first bearing secured to said distal end of said first coupling bar;

a second coupling bar having a proximal end and a distal end;

said proximal end of said second coupling bar traversing said second aperture and slidably engaging within said second interior bore of said second cylindrical tube;

a second bearing secured to said distal end of said second coupling bar;

a first lock engaging said first cylindrical tube and said first coupling bar for terminating displacement of said first coupling bar relative to said first cylindrical tube;

a second lock engaging said second cylindrical tube and said second coupling bar for terminating displacement of said second coupling bar relative to said second cylindrical tube;

a pin extending between said first bearing and said second bearing for pivoting said first clamp relative to said second clamp;

said first cylindrical tube and said first coupling bar and said second cylindrical tube and said second coupling bar defining a first length between said first clamp and said second clamp; and said displacement of said first coupling bar relative to said first cylindrical tube and/or displacement of said second coupling bar relative to said second cylindrical tube defining a second length between said first clamp and the second clamp.

6. A mooring device for securing a boat to an object as set forth in claim 1, wherein said first plurality of fingers including primary finger, a secondary finger and a central finger coupled by a first beam;

said primary finger, said secondary finger and said central finger of said first plurality of fingers having an arcuate bend for traversing said second channel, said third channel and said first channel of the first cleat respectively;

said first beam having a primary pivot arm, a secondary pivot arm and a central pivot arm positioned above said primary finger, said secondary finger and said central finger;

said second plurality of fingers including a major primary finger, a minor primary finger, a major secondary finger, a minor secondary finger, a major central finger and a minor central finger coupled by a second beam;

said major primary finger and said minor primary finger, said major secondary finger and said minor secondary finger, said major central finger and said minor central finger having an arcuate bend for traversing said second channel, said third channel and said first channel of the first cleat respectively;

said second beam having a major primary pivot arm and a minor primary pivot arm, a major secondary pivot arm and a minor secondary pivot arm, a major central pivot arm and a minor central pivot arm positioned above said major primary finger and said minor primary finger, said major secondary finger and said minor secondary finger, said major central finger and said minor central finger respectively;

a first pin bore traversing said primary pivot arm, said secondary pivot arm and said central pivot arm of said first beam;

a second pin bore traversing said major primary pivot arm and said minor primary pivot arm, said major secondary pivot arm and said minor secondary pivot arm, said major central pivot arm and said minor central pivot arm of said second beam;

said primary pivot arm, said secondary pivot arm and said central pivot arm of said first beam inserting between said major primary pivot arm and said minor primary pivot arm, said major secondary pivot arm and said minor secondary pivot arm, said major central pivot arm and said minor central pivot arm of said second beam respectively; and a first clamp pin traversing said first pin bore and said second pin bore for pivoting said second plurality of fingers relative to said first plurality of fingers.

7. A mooring device for securing a boat to an object as set forth in claim 1, wherein said third plurality of fingers including primary finger, a secondary finger and a central finger coupled by a third beam;

said primary finger, said secondary finger and said central finger of said third plurality of fingers having an arcuate bend for traversing said second channel, said third channel and said first channel of the second cleat respectively;

said third beam having a primary pivot arm, a secondary pivot arm and a central pivot arm positioned above said primary finger, said secondary finger and said central finger;

said fourth plurality of fingers including a major primary finger, a minor primary finger, a major secondary finger, a minor secondary finger, a major central finger and a minor central finger coupled by a fourth beam;

said major primary finger and said minor primary finger, said major secondary finger and said minor secondary finger, said major central finger and said minor central finger having an arcuate bend for traversing said second channel, said third channel and said first channel of the second cleat respectively;

said fourth beam having a major primary pivot arm and a minor primary pivot arm, a major secondary pivot arm and a minor secondary pivot arm, a major central pivot arm and a minor central pivot arm positioned above said major primary finger and said minor primary finger, said major secondary finger and said minor secondary finger, said major central finger and said minor central finger respectively;

a third pin bore traversing said primary pivot arm, said secondary pivot arm and said central pivot arm of said third beam;

a fourth pin bore traversing said major primary pivot arm and said minor primary pivot arm, said major secondary pivot arm and said minor secondary pivot arm, said major central pivot arm and said minor central pivot arm of said fourth beam;

said primary pivot arm, said secondary pivot arm and said central pivot arm of said third beam inserting between said major primary pivot arm and said minor primary pivot arm, said major secondary pivot arm and said minor secondary pivot arm, said major central pivot arm and said minor central pivot arm of said fourth beam respectively; and a second clamp pin traversing said third pin bore and said fourth pin bore for pivoting said fourth plurality of fingers relative to said third plurality of fingers.

8. A mooring device for securing a boat to an object as set forth in claim 1, wherein said second plurality of fingers includes a first lever arm for assisting in pivoting said second plurality of fingers about said proximal end of said bar; and said fourth plurality of fingers includes a second lever arm for assisting in pivoting said fourth plurality of fingers about said distal end of said bar.

9. A mooring device for securing a boat to an object as set forth in claim 1, further including a first clamp pin traversing said first plurality of fingers and said second plurality of fingers for pivoting said second plurality of fingers relative to said first plurality of fingers;

a second clamp pin traversing said third plurality of fingers and said fourth plurality of fingers for pivoting said fourth plurality of fingers relative to said second plurality of fingers; and a first rod spring encircling said first clamp pin and engaging between said first plurality of fingers and said second plurality of fingers for biasing said second plurality of fingers into an interlocking position with said first plurality of fingers; and a second rod spring encircling said second clamp pin and engaging between said third plurality of fingers and said fourth plurality of fingers for biasing said fourth plurality of fingers into an interlocking position with said third plurality of fingers.

10. A mooring device for securing a boat to an object as set forth in claim 1, further including a first lock bracket pivotably mounted to said second plurality of fingers and traversing the second channel of the first cleat;

a second lock bracket pivotably mounted to said second plurality of fingers and traversing the third channel of the first cleat;

a first lock pin traversing from said first lock bracket, behind said first plurality of fingers and traversing said second lock bracket for retaining said first plurality of fingers and said second plurality of fingers in an interlocking position;

a third lock bracket pivotably mounted to said fourth plurality of fingers and traversing the second channel of the second cleat;

a fourth lock bracket pivotably mounted to said fourth plurality of fingers and traversing the third channel of the second cleat; and a second lock pin traversing from said third lock bracket, behind said third plurality of fingers and traversing said fourth lock bracket for retaining said third plurality of fingers and said fourth plurality of fingers in an interlocking position.

11. A mooring device for securing a boat to an object as set forth in claim 1, wherein said first plurality of fingers and said second plurality of fingers, said third plurality of fingers and said fourth plurality of fingers include a polymeric coating for preventing scaring of the first cleat and the second cleat respectively.

12. A mooring device for securing a boat to an object, the boat having a first cleat, the object having a second cleat, the first and second cleat having a first vertical member and a second vertical member separated by a horizontal member, the first vertical member and the second vertical member and the horizontal member defining a first channel, the first vertical member including a first horn aligned with the horizontal member, the first horn and first vertical member defining a second channel, the second vertical member including a second horn aligned with the horizontal member, the second horn and the second vertical member defining a third channel, the mooring device, comprising:

a bar having a proximal end and a distal end;

said bar further includes a first cylindrical tube extending from said first clamp to a first aperture and a second cylindrical tube extending from said second clamp to a second aperture;

said first cylindrical tube defining a first interior bore;

said second cylindrical tube defining a second interior bore;

a first bearing secured to said first aperture of said first cylindrical tube;

a second bearing secured to said second aperture of said second cylindrical tube;

a pin extending between said first bearing and said second bearing for pivoting said first clamp relative to said second clamp;

a first plurality of fingers integral to said proximal end of said bar for engaging the first channel, the second channel and the third channel of the first cleat;

a second plurality of fingers pivotably engaging said proximal end of bar for engaging the first channel, the second channel and the third channel of the first cleat;

said first plurality of fingers interlock with said second plurality of fingers for defining a first clamp engaging the first cleat;

a third plurality of fingers integral to said distal end of said bar for engaging the first channel, the second channel and the third channel of the second cleat;

a fourth plurality of fingers pivotably engaging said distal end of bar for engaging the first channel, the second channel and the third channel of the second cleat;

said third plurality of fingers interlock with said fourth plurality of fingers for defining a second clamp engaging the second cleat; and said first clamp and said second clamp coupling said bar between the first cleat and the second cleat for securing the boat to the object.

13. A mooring device for securing a boat to an object, the boat having a first cleat, the object having a second cleat, the first and second cleat having a first vertical member and a second vertical member separated by a horizontal member, the first vertical member and the second vertical member and the horizontal member defining a first channel, the first vertical member including a first horn aligned with the horizontal member, the first horn and first vertical member defining a second channel, the second vertical member including a second horn aligned with the horizontal member, the second horn and the second vertical member defining a third channel, the mooring device, comprising:

a bar having a proximal end and a distal end;

a first plurality of fingers integral to said proximal end of said bar for engaging the first channel, the second channel and the third channel of the first cleat;

a second plurality of fingers pivotably engaging said proximal end of bar for engaging the first channel, the second channel and the third channel of the first cleat;

said first plurality of fingers interlock with said second plurality of fingers for defining a first clamp engaging the first cleat;

a third plurality of fingers integral to said distal end of said bar for engaging the first channel, the second channel and the third channel of the second cleat;

a fourth plurality of fingers pivotably engaging said distal end of bar for engaging the first channel, the second channel and the third channel of the second cleat;

said third plurality of fingers interlock with said fourth plurality of fingers for defining a second clamp engaging the second cleat;

said first clamp and said second clamp coupling said bar between the first cleat and the second cleat for securing the boat to the object; and said first plurality of fingers and said second plurality of fingers, said third plurality of fingers and said fourth plurality of fingers include a polymeric coating for preventing scaring of the first cleat and the second cleat respectively.

14. A mooring device for securing a boat to an object, the boat having a first cleat, the object having a second cleat, the first cleat and the second cleat having a first vertical member and a second vertical member secured perpendicularly to a horizontal member, the horizontal member extending between a first cleat end and a second cleat end, the mooring device, comprising:

a bar having a proximal end and a distal end;

a first C-clamp securing to said proximal end of said bar for engaging the first cleat to said bar;

said first C-clamp including a primary C-clamp arm and a secondary C-clamp arm;

said primary C-clamp arm of said first C-clamp extending between a major cylindrical channel and a major cleat socket;

said secondary C-clamp arm of said first C-clamp extending between a minor rod and a minor cleat socket;

said minor rod of said secondary C-clamp arm of said first C-clamp slidably engaging within said major cylindrical channel of said primary C-clamp arm of said first C-clamp for adjusting the distance between said major cleat socket and said minor cleat socket of said first C-clamp;

a first C-clamp stop locking said secondary C-clamp arm of said first C-clamp relative to said primary C-clamp arm of said first C-clamp for terminating displacement between said major cleat socket and said minor cleat socket of said first C-clamp;

said major cleat socket and said minor cleat socket of said first C-clamp engaging the first cleat end and the second cleat end of said first cleat respectively upon said minor rod of said secondary C-clamp arm of said first C-clamp slidably engaging within said major cylindrical channel of said primary C-clamp arm of said first C-clamp for securing the first cleat to said bar and defining a first cleat pivot;

said first cleat pivot permitting said first C-clamp to pivot relative to the first cleat;

a second C-clamp securing to said distal end of said bar for engaging the second cleat to said bar;

said second C-clamp including a primary C-clamp arm and a secondary C-clamp arm;

said primary C-clamp arm of said second C-clamp extending between a major cylindrical channel and a major cleat socket;

said secondary C-clamp arm of said second C-clamp extending between a minor rod and a minor cleat socket;

said minor rod of said secondary C-clamp arm of said second C-clamp slidably engaging within said major cylindrical channel of said primary C-clamp arm of said second C-clamp for adjusting the distance between said major cleat socket and said minor cleat socket of said second C-clamp;

a second C-clamp stop locking said secondary C-clamp arm of said second C-clamp relative to said primary C-clamp arm of said second C-clamp for terminating displacement between said major cleat socket and said minor cleat socket of said second C-clamp;

said major cleat socket and said minor cleat socket of said second C-clamp engaging the first cleat end and the second cleat end of said second cleat respectively upon said minor rod of said secondary C-clamp arm of said second C-clamp slidably engaging within said major cylindrical channel of said primary C-clamp arm of said second C-clamp for securing the second cleat to said bar and defining a second cleat pivot; and said second cleat pivot permitting said second C-clamp to pivot relative to the second cleat.

15. A mooring device for securing a boat to an object as set forth in claim 14, wherein said major cleat socket and said minor cleat socket of said first C-clamp includes a first concave receiver for conforming to the first cleat end and the second cleat end of said first cleat respectively; and said major cleat socket and said minor cleat socket of said second C-clamp includes a second concave receiver for conforming to the first cleat end and the second cleat end of said second cleat respectively.

16. A mooring device for securing a boat to an object as set forth in claim 14, further including a first C-clamp pivot pivotably secures proximal end of said bar to said first C-clamp for altering a first angle between said first C-clamp and said bar; and a second C-clamp pivot pivotably secures distal end of said bar to said second C-clamp for altering a second angle between said second C-clamp and said bar.

17. A mooring device for securing a boat to an object as set forth in claim 14, further including a first C-clamp pivot pivotably secures said proximal end of said bar to said first C-clamp for altering a first angle between said first C-clamp and said bar;

a first C-clamp pivot lock engaging said first C-clamp pivot for terminating pivoting of said proximal end of said bar relative to said first C-clamp;

a second C-clamp pivot pivotably secures said distal end of said bar to said second C-clamp for altering a second angle between said second C-clamp and said bar; and a second C-clamp pivot lock engaging said second C-clamp pivot for terminating pivoting of said distal end of said bar relative to said second C-clamp.

18. A mooring device for securing a boat to an object as set forth in claim 14, wherein said first C-clamp stop includes a plurality of ribs integral to said minor rod of said secondary C-clamp arm of said first C-clamp;

a first finger ratchet slidably engaging within said first C-clamp for inserting into said plurality of ribs;

said first finger ratchet being displaceable over said plurality of ribs upon said major cleat socket directed towards said minor cleat socket of said first C-clamp;

said first finger ratchet interlocked within one of said plurality of ribs upon said major cleat socket directed away from said minor cleat socket of said first C-clamp;

said second C-clamp stop includes a plurality of ribs integral to said minor rod of said secondary C-clamp arm of said second C-clamp;

a second finger ratchet slidably engaging within said second C-clamp for inserting into said plurality of ribs;

said second finger ratchet being displaceable over said plurality of ribs upon said major cleat socket directed towards said minor cleat socket of said second C-clamp; and said second finger ratchet interlocked within one of said plurality of ribs upon said major cleat socket directed away from said minor cleat socket of said second C-clamp.

19. A mooring device for securing a boat to an object as set forth in claim 14, wherein said first C-clamp stop includes a first C-clamp bolt extending between a first bolt end and a second bolt end;

said first bolt end of said first C-clamp bolt having a first head coupled to said primary C-clamp arm of said first C-clamp;

said second bolt end of said first C-clamp bolt having a first thread slidably engaging said secondary C-clamp arm of said first C-clamp;

a first C-clamp nut threadably engaging said first thread for applying a first compressive force between said primary C-clamp arm and said secondary C-clamp arm of said first C-clamp;

said first compressive force preventing said primary C-clamp arm of said first C-clamp from being distanced from secondary C-clamp arm of said first C-clamp;

said second C-clamp stop includes a second C-clamp bolt extending between a first bolt end and a second bolt end;

said first bolt end of said second C-clamp bolt having a first head coupled to said primary C-clamp arm of said second C-clamp;

said second bolt end of said second C-clamp bolt having a second thread slidably engaging said secondary C-clamp arm of said second C-clamp;

a second C-clamp nut threadably engaging said second thread for applying a second compressive force between said primary C-clamp arm and said secondary C-clamp arm of said second C-clamp; and said second compressive force preventing said primary C-clamp arm of said second C-clamp from being distanced from secondary C-clamp arm of said second C-clamp.

20. A mooring device for securing a boat to an object as set forth in claim 14, wherein said proximal end of said bar including a first arcuate bend for positioning said bar above said first C-clamp;

said distal end of said bar including a second arcuate bend for positioning said bar above said second C-clamp; and said first arcuate bend aligning with said second arcuate bend for aligning said first C-clamp and said second C-clamp.

21. A mooring device for securing a boat to an object as set forth in claim 14, wherein said bar further includes a first cylindrical tube extending from said first C-clamp to a first aperture and a second cylindrical tube extending from said second C-clamp to a second aperture;

said first cylindrical tube defining a first interior bore;

said second cylindrical tube defining a second interior bore;

a coupling bar having a proximal end and a distal end;

said proximal end of said coupling bar traversing said first aperture and slidably engaging within said first interior bore of said first cylindrical tube;

said distal end of said coupling bar traversing said second aperture and slidably engaging within said second interior bore of said second cylindrical tube;

a first lock engaging said first cylindrical tube and said coupling bar for terminating displacement of said coupling bar relative to said first cylindrical tube;

a second lock engaging said second cylindrical tube and said coupling bar for terminating displacement of said coupling bar relative to said second cylindrical tube;

said first cylindrical tube and said second cylindrical tube and said coupling bar defining a first length between said first C-clamp and said second C-clamp; and said displacement of said coupling bar relative to said first cylindrical tube and said second cylindrical tube defining a second length between said first C-clamp and said second C-clamp.

22. A mooring device for securing a boat to an object as set forth in claim 14, wherein said bar further includes a first cylindrical tube extending from said first C-clamp to a first aperture and a second cylindrical tube extending from said second C-clamp to a second aperture;

said first cylindrical tube defining a first interior bore;

said second cylindrical tube defining a second interior bore;

a first bearing secured to said first aperture of said first cylindrical tube;

a second bearing secured to said second aperture of said second cylindrical tube; and a pin extending between said first bearing and said second bearing for pivoting said first C-clamp relative to said second C-clamp.

* * * * *